United States Patent [19]

Friedman et al.

[11] Patent Number: 4,972,953

[45] **Date of Patent: * Nov. 27, 1990**

[54] TAMPER-EVIDENT PACKAGING, METHOD OF MAKING SAME AND INTERMEDIATE THEREIN

[75] Inventors: Herbert Friedman, Fort Lee, N.J.; James Danelski, New York, N.Y.

[73] Assignee: Ivy Hill Corporation, New York, N.Y.

[ * ] Notice: The portion of the term of this patent subsequent to Jan. 12, 2005 has been disclaimed.

[21] Appl. No.: 366,172

[22] Filed: Jun. 14, 1989

[51] Int. Cl.[5] ..... B65D 65/40

[52] U.S. Cl. ..... 206/459; 206/807; 215/365; 229/102

[58] Field of Search ..... 206/459, 807; 215/365; 116/201; 383/5; 229/102.

[56] References Cited

U.S. PATENT DOCUMENTS

| | | | |
|---|---|---|---|
| 3,899,295 | 8/1975 | Halpern | 206/459 |
| 4,180,929 | 1/1980 | Schultz, Jr. . | |
| 4,291,807 | 9/1981 | Giorando et al. | 206/807 |
| 4,344,533 | 8/1982 | Olsen | 206/459 |
| 4,479,588 | 10/1984 | Davis | 229/102 |
| 4,480,749 | 11/1984 | Laucis et al. | 206/459 |
| 4,501,388 | 2/1985 | Cassidy | 206/807 |
| 4,526,752 | 7/1985 | Perlman et al. | 116/207 |
| 4,546,881 | 10/1985 | Tasma | 206/459 |
| 4,614,297 | 9/1986 | Davis et al. | 229/132 |
| 4,718,553 | 1/1988 | Adamoli . | |
| 4,779,733 | 10/1988 | Kilian | 206/459 |
| 4,838,708 | 6/1989 | Holcomb et al. | 206/807 |

OTHER PUBLICATIONS

Food and Drug Packaging, vol. 52, Issue 4 (Apr. 1988) p. 26 "Packaging Product News", TE Labelstock.

Food and Drug Packaging (Jun. 1988), "Pack Alimentaire", p. 59, Tamper Evidence.

Packaging Digest, "Double Label is Twice as Secure".

Packaging Digest (Sep. 1988) "Burroughs Betters FDA Standard".

*Primary Examiner*—David T. Fidei

*Attorney, Agent, or Firm*—Amster, Rothstein & Ebenstein

[57] ABSTRACT

Tamper-evident packaging comprises an erected, filled, and closed carton having an outer surface with ink printed thereon visible from outside of the closed carton, and transparent film overwrapping the closed carton and secured to the ink on the outer carton surface in selected differentially adherent patterns. Removal of the film from the overwrapped carton also removes the ink in one of the patterns to reveal the desired pattern of deinked outer carton surface and to thereby evidence tampering with the packaging.

102 Claims, 10 Drawing Sheets

FIG. 1
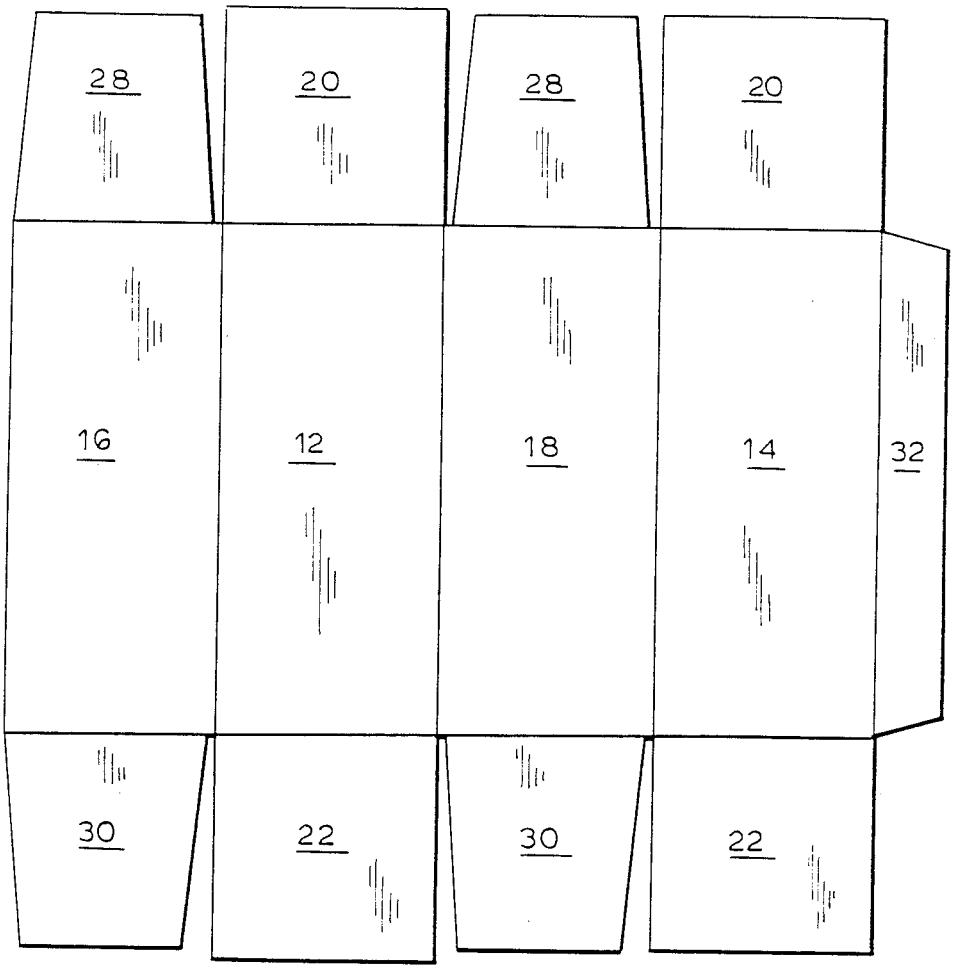
FIG. 2
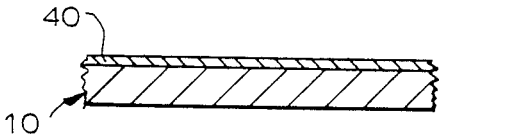
FIG. 3
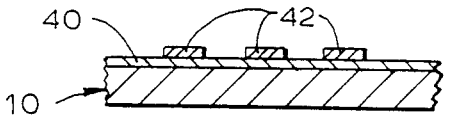
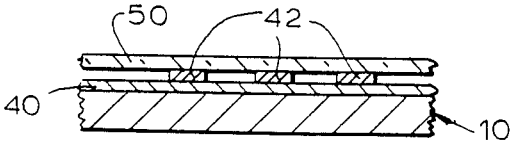
FIG. 4
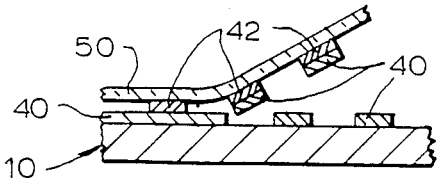
FIG. 5

FIG. 8
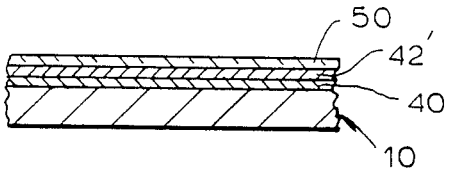
FIG. 11
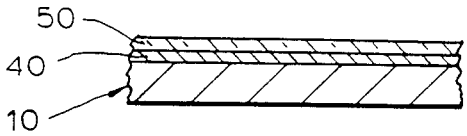
FIG. 9
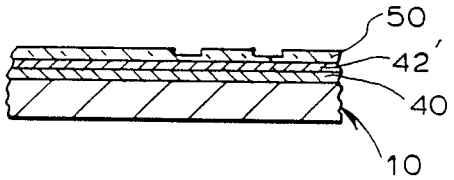
FIG. 12
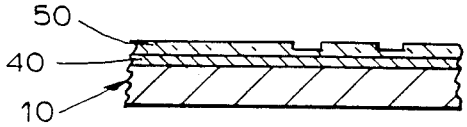
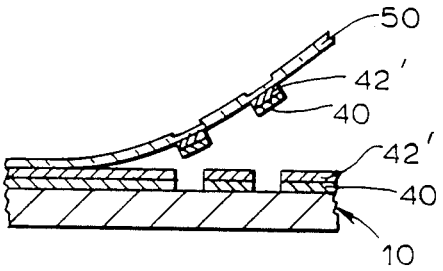
FIG. 10
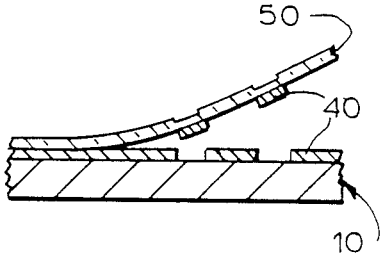
FIG. 13

FIG. 17
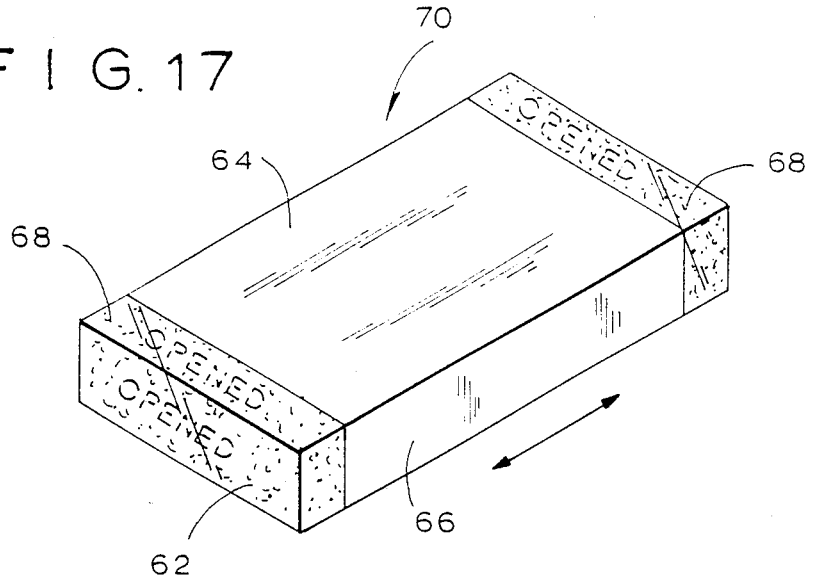
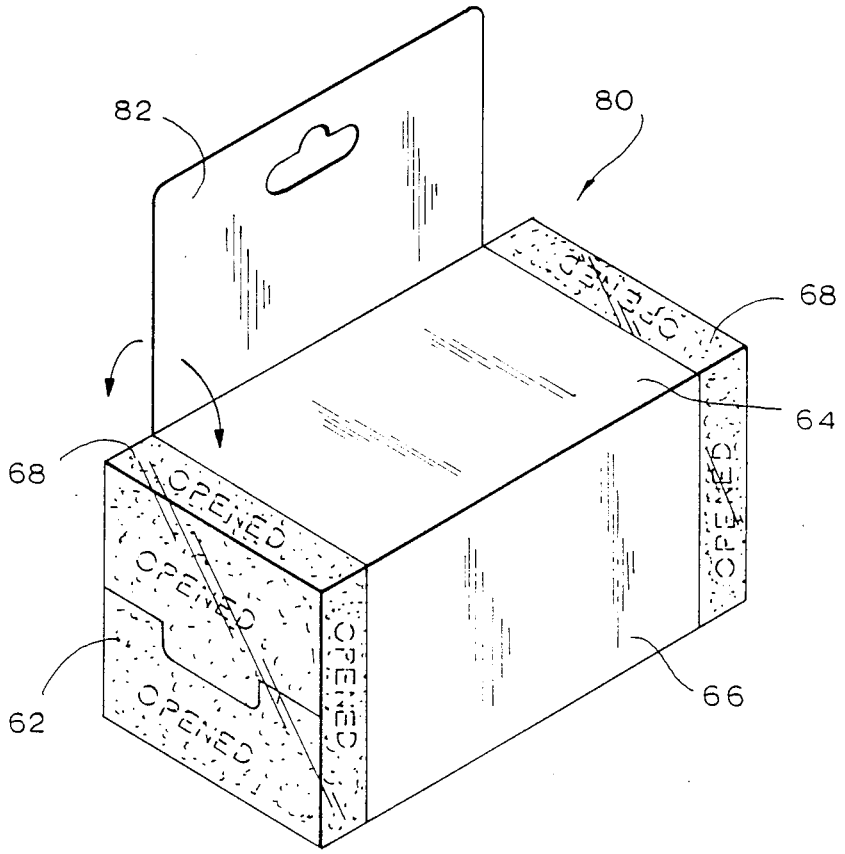
FIG. 18

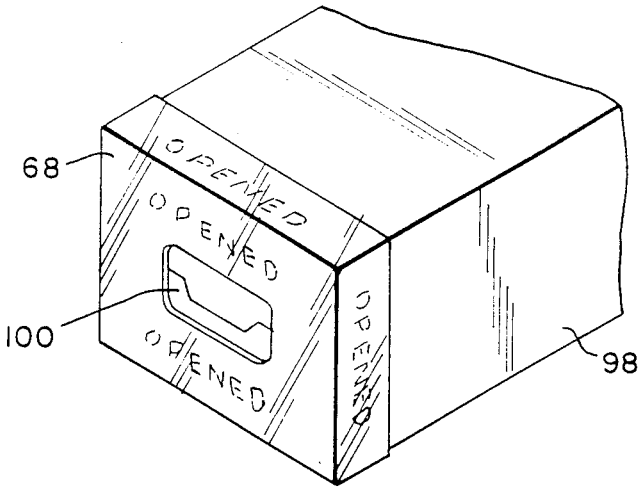
FIG. 21
FIG. 22A
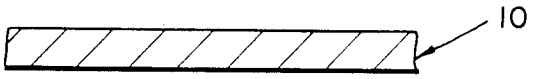
FIG. 22B
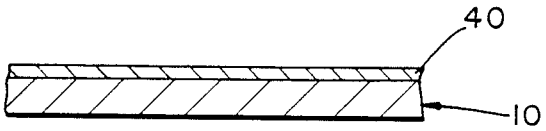
FIG. 22C
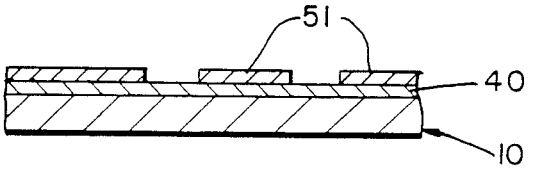
FIG. 22D
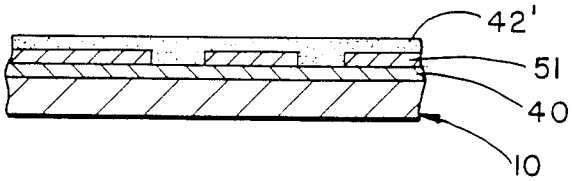
FIG. 22E
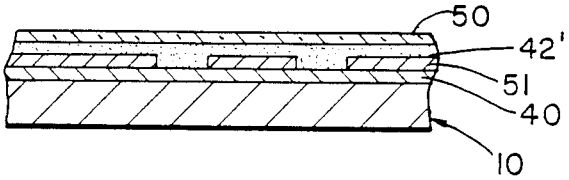
FIG. 22F
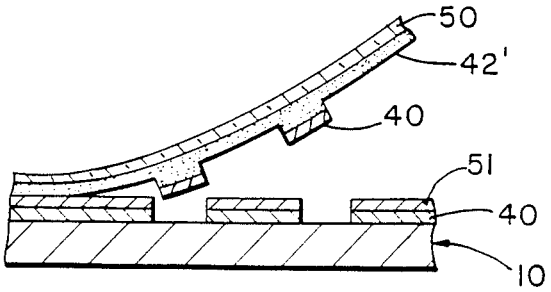

FIG. 23A
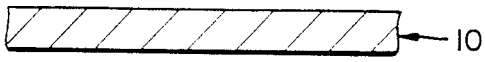
FIG. 23B
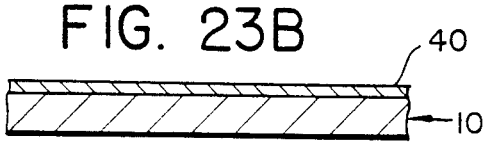
FIG. 23C
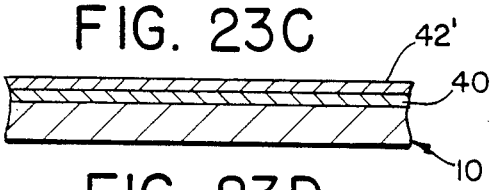
FIG. 23D
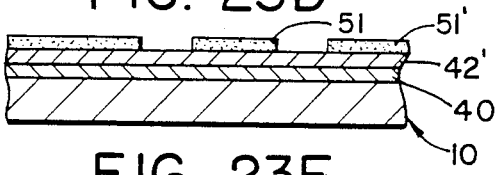
FIG. 23E
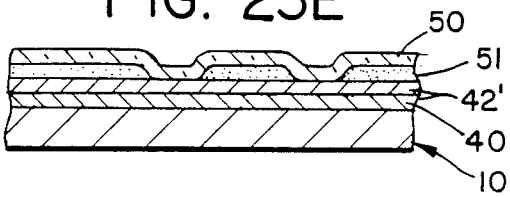
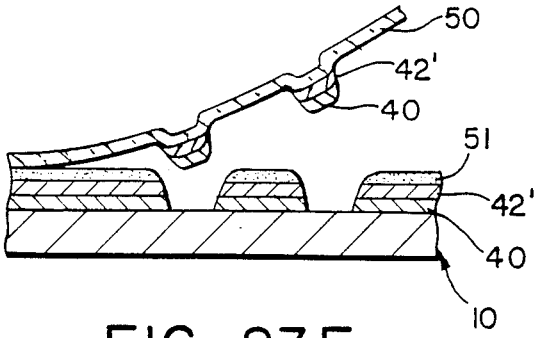
FIG. 23F
FIG. 24A
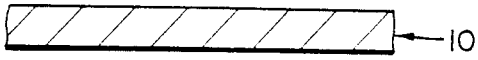
FIG. 24B
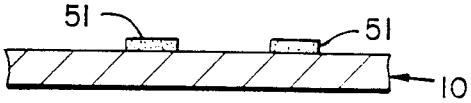
FIG. 24C
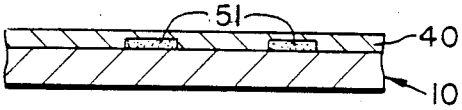
FIG. 24D
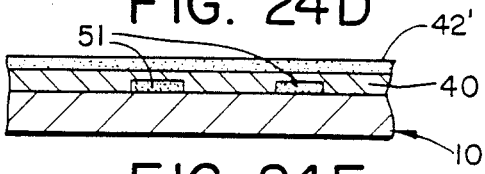
FIG. 24E
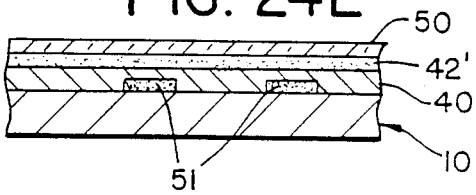
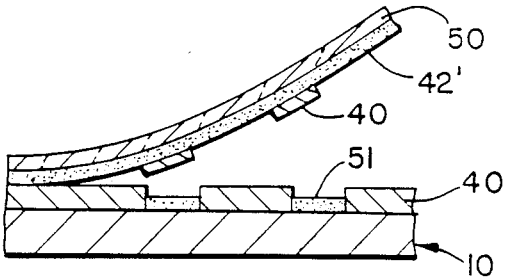
FIG. 24F FIG. 25
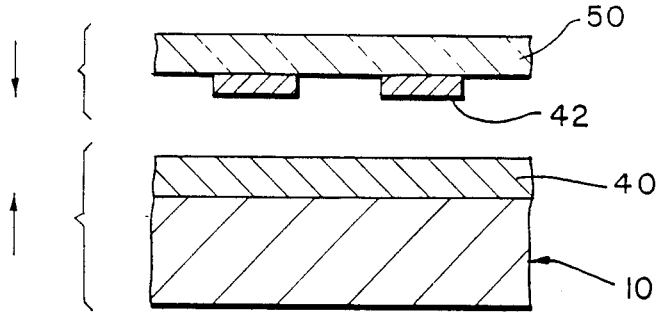
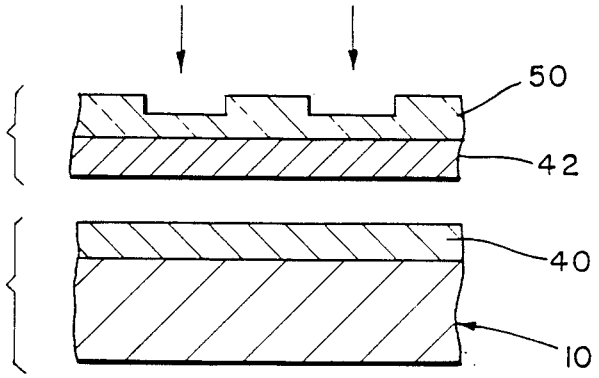
FIG. 26

FIG. 27
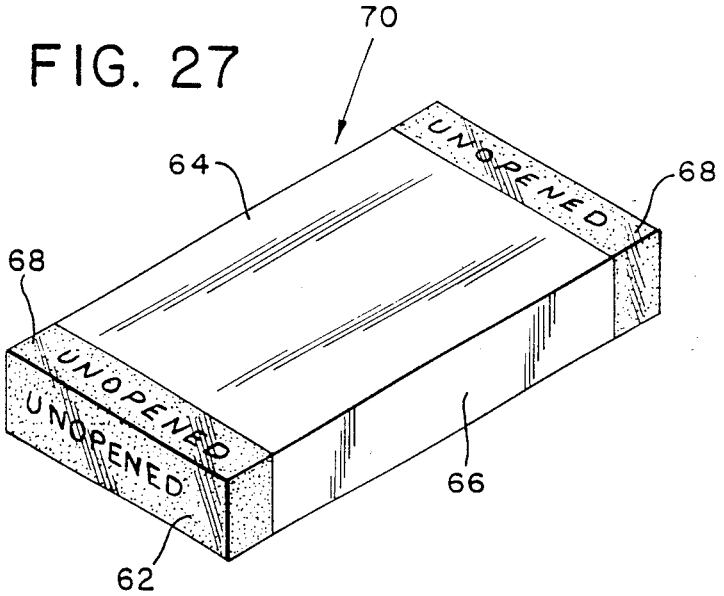
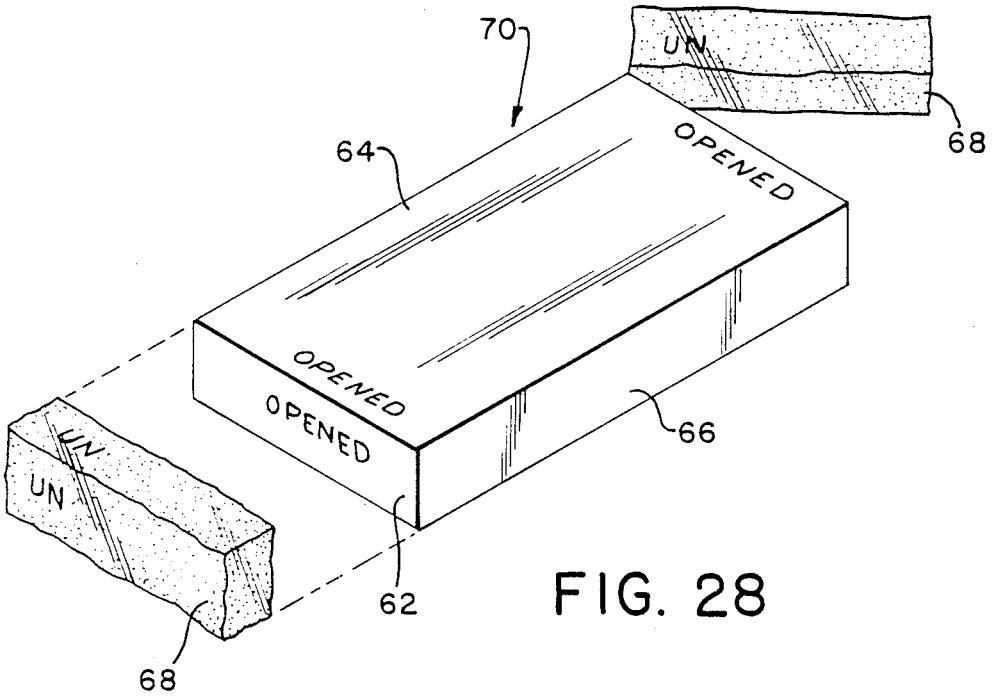
FIG. 28

TAMPER-EVIDENT PACKAGING, METHOD OF MAKING SAME AND INTERMEDIATE THEREIN

BACKGROUND OF THE INVENTION

The present invention relates to packaging and, more particularly to tamper-evident packaging of the type which clearly evidences to a potential purchaser of the product whether or not the integrity of the packaging has been breached.

In recent years, illegal tampering with just a few packages of consumer products, especially consumer products intended for ingestion, have caused death, illness, widespread public fear and the costly recall of millions of packages from retailer's shelves. As a result, there have been numerous and diverse attempts to provide packaging which would show positive visual evidence of any attempt to compromise the integrity or otherwise tamper with the containers in which such products as over the counter drugs, pharmaceuticals, foods or the like are typically packaged. However, none of the commonly used tamper-evident packaging techniques involving folding carton packages have proven to be entirely satisfactory in use. The gluing or sealing of carton ends together has not hampered a skilled and determined tamperer from, for example, using a sharp blade to cut through the carton sealing adhesive, adulterating the contents of the inner package, and then regluing the carton ends without leaving any telltale indication that the integrity of the packaging has been compromised. The use of heat-sealed or shrink type carton overwrap has not deterred tamperers as the overwrap material is generally available so that the tamperer can easily remove the overwrap from the carton, adulterate the contents of the carton, and apply look alike overwrap to the carton without leaving any indication that the carton integrity has been compromised. A reliabletamper-evident packaging system must ensure that the tampering causes a permanent change to an essential element of the packaging which is visually evident.

Various patents have been directed to tamper-evident packaging, switch-proof labels and the like.

U.S. Pat. No. 4,097,236 discloses a tamper-evident system which relies on the principle that a ruptured heat seal exhibits a different color than an unruptured heat seal.

U.S. Pat. No. 4,246,307 discloses a laminated sticker card, the laminate including a printed inner layer which adheres to a substrate and an outer layer. Portions of the printed inner layer adjacent the substrate are preferentially adhered at certain locations to the substrate and at other locations to the outer layer of the laminate, so that an attempt to remove the laminate from the substrate results in tearing of the printed inner layer at the preferentially adhered locations.

U.S. Pat. Nos. 1,003,443 and 4,082,873 disclose switch proof labels which are intended to prevent labels from being removed from one container and applied to another by causing the tampering to destroy the visual integrity of the labels.

However each of these patented systems requires that the user be alert to the special circumstances which indicate tampering. In other words, the systems fail to provide an unequivocal message which even the first time user of the product will recognize as an intended communication, let alone a warning of tampering.

Accordingly, it is an object of the present invention to provide tamper-evident packaging wherein the tampering is evidenced by the appearance of a desired graphic or verbal communication on the outer surface of the container.

Another object is to providetamper-evident packaging in which removal of a carton overwrap causes clear and unequivocal notice of tampering to appear on the carton surface, so that such notice will remain on the carton surface even if new overwrap is applied thereto or other steps are taken to attempt to hide the evidence of tampering.

A further object is to provide suchtamper-evident packaging at only a minimal cost over regular packaging.

It is also an object to provide a method of manufacturing such tamper-evident packaging and an intermediate useful in such manufacture.

SUMMARY OF THE INVENTION

It has now been found that the above and related objects of the present invention are obtained in tamper-evident packaging comprising an erected, filled, and closed carton having an outer surface with ink thereon visible from outside of the closed carton. A transparent film overwraps the closed carton and is secured to the ink on the outer carton surface in selected differentially adherent patterns. Removal of the film from the overwrapped carton also removes the ink in one of the patterns to reveal the desired pattern of deinked outer carton surface and thereby evidence tampering.

In a first preferred embodiment of the present invention, the packaging additionally comprises a transparent heat-sealable coating disposed in the one selected pattern intermediate the ink and the film, the coating being bonded to an underlying portion of the ink and to the film. Thus, removal of the film from the overwrapped carton also removes the coating and the underlying portion of the ink in the one selected pattern to reveal an outer carton surface deinked in the configuration of a meaningful message to evidence tampering. In a second preferred embodiment, the packaging additionally comprises a transparent heat-sealable coating uniformly disposed intermediate the ink and the film. The coating is uniformly bonded to the underlying ink and has been activated by a selective application of heat and pressure to bond in the one selected pattern with the film. Thus, removal of the film from the overwrapped carton also removes coating in the one selected pattern and an underlying portion of the ink in the one selected pattern to reveal an outer carton surface deinked in the form of a meaningful message to evidence tampering. In a third preferred embodiment, the film is directly and immediately secured to the ink on the outer carton surface in selected differentially adherent patterns as a result of the selective application of heat and pressure to the film. When the film is removed from the carton, the film causes removal of the ink from the outer carton surface in a selected pattern to evidence tampering. Thus, the tamper-evident packaging of the present invention encompasses three preferred embodiments: a first wherein there is a given pattern of heat-sealable coating on the ink, a second wherein the heat-sealable coating is uniformly disposed over the ink but heat and pressure are applied to the film in the given pattern, and a third wherein there is no heat-sealable coating but the film is directly and immediately secured to the ink in the given pattern as a result of the differential application of heat and pressure to the film.

In the preferred first embodiment, the ink is secured to the outer carton surface in a pattern of surface detail by a first bond, the transparent heat-sealable coating is secured to the ink in a given pattern by a second bond, and the overwrap film is secured to the patterned coating by a third bond. The second and third bonds are appreciably stronger than the first bond so removal of the film from the overwrapped carton also removes the coating and the portion of the ink underlying the coating to reveal a desired pattern of deinked outer carton surface and thereby evidence tampering. The bonding of the overwrap film to the heat-sealable coating may be achieved by the application of heat and pressure to the outer surface of the overwrap film, and preferably by the uniform application of heat and pressure over the entire outer surface of the overwrap film, or at least that portion of the outer film surface overlying the heat-sealable coating.

An intermediate in the manufacturing of the first embodiment of the tamper-evident packaging comprises a carton blank adapted to be erected into a carton, filled with product, closed, and overwrapped with a transparent film. Ink defining a pattern of surface detail is secured by a first bond to the surface of the blank becoming the outer surface of the erected carton. A transparent heat-sealable coating is disposed on the ink in a given pattern, the coating forming a second bond between the ink and coating and being activatable to form a third bond between the coating and the film. The second and third bonds are appreciably stronger than the first bond, whereby removal of the film from the overwrapped carton also removes the coating and the portion of the ink underlying the coating to reveal a pattern of deinked outer carton surface and to thereby evidence tampering.

Preferably the second and third bonds are of generally equal strength and the ink is either substantially not heat sealable with the film in the absence of the coating therebetween or the direct and immediate bonding of the ink to the film is weaker than the first bond. The coating is preferably disposed on the ink in the given pattern such that removal of the ink in the given pattern reveals indicia evidencing tampering. The given pattern comprises indicia evidencing tampering and may comprise graphic or verbal communications (such as a skull and crossbones or the words "VOID", "TAMPERED", "UNSEALED" or "UNSAFE"). Preferably the carton is comprised of clay-coated paperboard, the ink is ultraviolet lithographic ink, the coating is solvent-based, and the film is polyvinyl chloride (PVC). The coating is typically activated by the application of heat and pressure to form the third bond, for example, at 200°–300° F. and 10–20 psi for 1–2 seconds.

Thetamper-evident packaging of the present invention is made by providing an erected, filled and closed carton having an outer surface with ink thereon visible from outside the closed carton. The closed carton is overwrapped with a transparent film, and the film is secured to the ink on the outer carton surface in selected differentially adherent patterns. Removal of the film from the overwrapped carton also removes the ink in one of the selected patterns to reveal the desired pattern of deinked outer carton surface to evidence tampering.

To make the first embodiment, prior to the overwrapping step a transparent heat-sealable coating is disposed in the one selected pattern on the outer carton surface and uniformly bonded to the underlying portions of the ink. During the overwrapping step the film is secured to the ink by activating the coating with a uniform application of heat and pressure to bond the coating to the film in the one selected pattern. Thus, removal of the film from the overwrapped carton also removes the coating and the underlying portion of the ink, both in the one selected pattern, to reveal an outer carton surface deinked in the form of a meaningful message to evidence tampering. To make the second embodiment, prior to the overwrapping step a transparent heat-sealable coating is uniformly disposed on the outer carton surface and uniformly bonded to the underlying ink, and during the overwrapping step the coating is activated by the selective application of heat and pressure to bond the coating in the one selected pattern with the film. Thus, removal of the film from the overwrapped carton also removes the one selected pattern of coating and the underlying portion of the ink in the one selected pattern to reveal an outer carton surface deinked in the form of a meaningful message to evidence tampering. The ink is secured to the outer carton surface by a first bond, the heat-sealable coating is secured to the ink by a second bond, and the film is secured to the coating by a third bond, the second and third bonds being stronger than the first bond. To make the third embodiment, during the overwrapping step the film is directly and immediately secured to the ink on the outer carton surface in selected differentially adherent patterns as a result of the differential application of heat and pressure to the film.

A method of manufacturing the intermediate of the first embodiment comprises the steps of providing a carton blank adapted to be erected into a carton, filled with product, closed, and overwrapped with a transparent film. Ink is applied in a pattern of surface detail to a surface of the blank becoming the outer surface of the erected carton, the ink being secured to the outer surface by a first bond. A transparent heat-sealable coating is applied on the ink in a given pattern, the coating forming a second bond with the ink and being activatable to form a third bond with the film, the second and third bonds being appreciably stronger than the first bond. Removal of the film from the overwrapped carton also removes the coating and the portion of the ink underlying the coating to reveal a desired pattern of deinked outer carton surface to evidence tampering.

In a variant of the first and second embodiments, a transparent heat-sealable coating is disposed intermediate the ink and the film, bonded to the film, and activated by heat and pressure to bond with an underlying portion of the ink. The transparent heat-sealable coating may be disposed in the selected pattern intermediate the ink and the film, and the coating activated by the uniform application of heat and pressure to bond uniformly with the underlying portion of the ink. Thus removal of the film from the overwrapped carton also removes the coating and the underlying portion of the ink in the one selected pattern to reveal an outer carton surface deinked in the form of a meaningful message to evidence tampering. Alternatively, the transparent heat-sealable coating may be uniformly disposed intermediate the ink and the film, and the coating activated by the selective application of heat and pressure to bond in the one selected pattern with the ink. Thus removal of the film from the overwrapped carton also removes the coating in the one selected pattern and an underlying portion of the ink in the one selected pattern to reveal an outer carton surface deinked in the form of a meaningful message to evidence tampering.

To manufacture tamper-evident packaging according to the variants of the first and second embodiments, prior to overwrapping of the closed carton with the transparent film, a transparent heat-sealable coating is disposed on the surface of the transparent film to be adjacent the outer carton surface, and during or after overwrapping the coating is activated by the application of heat and pressure to bond the coating to the ink.

Tamper-evident packaging according to the fourth embodiment comprises an erected, filled and closed package having an outer surface layer. An ink layer overlies at least a portion of the package outer surface layer, is visible from outside the closed package, and is bonded to an underlying layer other than a release coating. A transparent film layer overwraps at least a portion of the closed package, is disposed about the ink layer, and is bonded to an underlying layer other than a release coating. The ink layer is bonded to one of the transparent film and outer package surface layers uniformly and to the other of the layers in selected differentially adherent patterns, whereby removal of the film from the overwrapped packaqe also removes the ink in one of the selected patterns to reveal a desired pattern of deinked outer package surface and thereby evidence tampering. A release coating layer defining a pattern of release coating is disposed intermediate a pair of the aforesaid layers and causes the differential adhesion of the selected differentially adherent patterns.

More particularly, the release coating layer is disposed so as to either preclude removal of a selected pattern of the underlying one of the pair of layers with the removal of the overlying one of the pair of layers to reveal a desired pattern evidencing tampering or to enable removal of a selected pattern of the overlying one of the pair of layers from the underlying one of the pair of layers to reveal a desired pattern evidencing tampering.

Thus in one variant of the fourth embodiment the release coating layer is disposed intermediate the package outer surface layer and the ink layer and enables removal of the one selected pattern of the ink layer with the transparent film layer to reveal a desired pattern of deinking. Preferably the pattern of release coating is a positive image of the desired pattern of deinkinq. The release coating layer is either transparent or opaque. A transparent heat-sealable layer preferably overlies at least a portion of the closed packaqe, is disposed intermediate the ink and transparent film layers, and is bonded to underlying and overlyinq layers other than the release coating layer, the release coating layer enabling removal of the one selected pattern of the ink layer with the transparent film and heat-sealable layers to reveal the desired pattern of deinking.

In the other two variants of the fourth embodiment, the ink layer is uniformly bonded to the package outer surface layer, and the release coating layer is disposed intermediate the ink layer and the transparent film layer and precludes removal of a pattern of the ink layer with the transparent film layer to reveal a desired pattern of deinking. Preferably the pattern of release coating is provided as a negative image of the desired pattern of deinking and is transparent. A transparent heat-sealable layer overlies at least a portion of the closed package, is disposed intermediate the ink and transparent film layers, and is bonded to underlying and overlying layers other than the release coating layer.

In one of these two variants of the fourth embodiment the release coating layer is disposed intermediate the ink layer and the heat-sealable layer and precludes removal of a pattern of the ink layer with the transparent film and heat-sealable layers to reveal the desired pattern of deinking. All of the heat-sealable layer is directly bonded to the transparent film layer, whereby removal of a portion of the transparent film layer also removes the underlying portion of the heat-sealable layer. In the other of these two variants of the fourth embodiment, the release coating layer is disposed intermediate the heat-sealable layer and the transparent film layer and precludes removal of a pattern of the ink layer with the transparent film layers to reveal a desired pattern of deinking. Only a part of the heat-sealable layer is directly bonded to the transparent film layer, whereby removal of a portion of the transparent film layer also removes only a part of the underlying portion of the heat-sealable layer.

To manufacture tamper-evident packaging according to the fourth embodiment an erected, filled and closed package having an outer surface layer is provided. At least a portion of the package outer surface layer is overlayed with an ink layer visible from outside the closed package and bonded to an underlying layer other than a release coating. At least a portion of the closed package is overwrapped with a transparent film layer disposed about the ink laYer and bonded to an underlying layer other than a release coating. The ink layer is bonded to one of the transparent film and outer carton surface layers uniformly and to the other of the layers in selected differentially adherent patterns, whereby removal of the film from the overwrapped carton also removes the ink in one of the selected patterns to reveal a desired pattern of deinked outer carton surface and thereby evidence tampering. A release coating layer defining a pattern of release coating is disposed intermediate a pair of the aforesaid layers and causes the differential adhesion of the selected differentially adherent patterns.

Tamper-evident packaging according to the fifth embodiment comprises a filled and closed package having an outer surface with ink thereon visible from outside of the closed package, and an end cap of transparent film overwrapping a portion of the closed packaqe less than the entirety thereof. The film is secured to the ink on the outer package surface in selected differentially adherent patterns, whereby removal of the film from the overwrapped package also removes the ink in one of the selected patterns to reveal a desired pattern of deinked outer package surface and thereby evidence tampering.

Preferably the package defines at least a pair of opposed end panels and a sidewall panel extending between the end panels, and the end cap overwraps at least a portion of one of the end panels and an adjacent portion of the sidewall panel. It is especially preferred that the end cap overwraps the entirety of the one end panel, and the adjacent portion of the sidewall panel is either contiguous to or spaced from the one end panel and is less than the entirety of the sidewall panel. Another end cap may overwrap the entirety of the other of the end panels and a second adjacent portion of the sidewall panel so there are a spaced pair of the end caps, one for each of the end panels. The adjacent and second adjacent portions each comprise less than 50% of the length of the sidewall panel.

It is preferred that the film be heat shrinkable and the package include intermediate the end panels a reduced width section, the adjacent portion including the reduced width section.

The package may be formed substantially of a material other than paper or paperboard and contain as part of the outer package surface and as part of the adjacent portion a label of paper or paperboard having ink thereon visible from outside of the closed package. The film may be heat-shrinkable, include an at least partially transparent coating, and may be printed with indicia visible from outside of the overwrapped package. The film, when overwrapping the package, may be devoid of visible indicia and yet, when removed from the package, contain visible indicia.

A method of manufacturing tamper-evident packaging according to the fifth embodiment comprises the steps of providing a filled and closed package having an outer surface with ink thereon visible from outside of the closed package, overwrapping with an end cap of transparent film a portion of the closed package less than the entirety thereof, and securing the film to the ink on the outer package surface in selected differentially adherent patterns; whereby removal of the film from the overwrapped package also removes the ink in one of the selected patterns to reveal a desired pattern of deinked outer package surface and thereby evidence tampering.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 1 is a top plan view of an open carton blank;

FIG. 2 is a fragmentary sectional view of the carton blank of FIG. 1 having a layer of ink thereon;

FIG. 3 is a fragmentary sectional view of the composite of FIG. 2 having a pattern of heat-sealable coating thereon;

FIG. 4 is a fragmentary sectional view of the composite of FIG. 3 having a transparent overwrap thereon;

FIG. 5 is a fragmentary sectional view of the composite of FIG. 4 showing the overwrap being removed and taking therewith the heat-sealable coating and underlying portions of the ink;

FIG. 8 is a fragmentary sectional view of an intermediate in the manufacture of a second embodiment of the present invention prior to the selective application of heat and pressure;

FIG. 9 is a fragmentary sectional view of the composite of FIG. 8 after the selective application of heat and pressure;

FIG. 10 is a fragmentary sectional view of the composite of FIG. 9 showing the overwrap being removed and taking therewith portions of the heat-sealable coating and underlying portions of the ink;

FIG. 11 is a fragmentary sectional view of an intermediate in the manufacture of the third embodiment of the present invention prior to the selective application of heat and pressure FIG. 12 is a fragmentary sectional view of the composite of FIG. 11 after the selective application of heat and pressure;

FIG. 13 is a fragmentary sectional view of the composite of FIG. 12 showing the overwrap being removed and taking therewith portions of the ink;

FIG. 17 is an isometric view of a telescope carton according to the fifth embodiment, with the end caps extending over the end panels and the contiguous portions of the face and side panels;

FIG. 18 is an isometric view of a fifth panel carton according to the fifth embodiment, with the end caps extending over the end panels and the contiguous portions of the face and side panels;

FIG. 21 is a fragmentary isometric view of a carton having an end seal according to the fifth embodiment;

FIGS. 22A–E are fragmentary side elevation views, in section, showing the method of forming atamper-evident carton according to the fourth embodiment with the pattern of transparent release coating being intermediate the inked outer carton surface and the uniform transparent heat-sealable coating;

FIG. 22F is a fragmentary side elevation view, in section, of the carton of FIG. 22E as the transparent overwrap film is being remove therefrom;

FIGS. 23A–E are fragmentary side elevation views, in section, showing the method of forming a tamper-evident carton according to the fourth embodiment with the pattern of transparent release coating being intermediate the uniform transparent heat-sealable coating and the transparent overwrap film;

FIG. 23F is a fragmentary side elevation view, in section, of the carton of FIG. 23E as the transparent overwrap film is being removed therefrom;

FIGS. 24A–E are fragmentary side elevation views, in section, showing the method of forming a tamper-evident carton according to the fourth embodiment with the pattern of release coating being intermediate the carton outer surface and the ink layer;

FIG. 24F is a fragmentary side elevation view, in section, of the carton of FIG. 24E as the transparent overwrap film is being removed therefrom;

FIGS. 25 and 26 are fragmentary side elevation views of variations of the first and second embodiments, respectively, illustrating an overwrap film having a heat-sealable coating being bonded to an inked outer carton surface; and FIGS. 27 and 28 are isometric views of a package according to the present invention in the unopened state when it shows the message "UNOPENED" and in the opened state when it shows the message "OPENED", respectively.

DETAILED DESCRIPTION OF THE PREFERRED EMBODIMENTS

Figure 6:
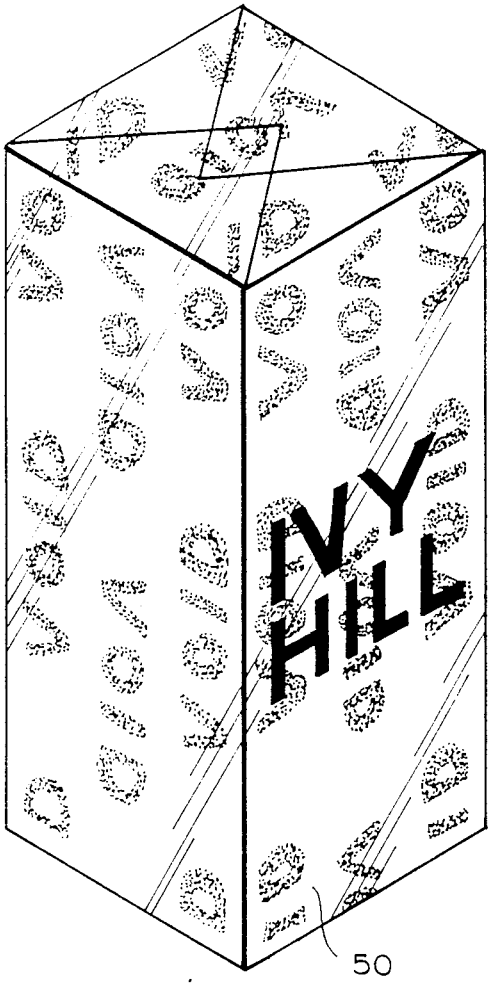
FIG. 6 is an isometric view of an untampered package according to the present invention with the word "VOID" being shown thereon with more prominence than would actually be the case.

Referring now to the drawing, and in particular to FIG. 1 thereof, therein illustrated is a carton blank generally designated by the reference numeral 10. The carton blank 10 is configured and dimensioned for eventual use as the familiar paperboard carton used for small medicaments, such as aspirin, and the like although the principles of the present invention are equally applicable to paperboard cartons of widely disparate sizes, shapes and styles. For example, the paperboard cartons may be of the seal-end or tuck-end styles, the former generally being considered as affording the most advantageous tamper-evident packaging characteristics but the latter, despite its deficiencies in this area, being made relatively more acceptable by the application of the principles of the present invention thereto. The illustrated carton 10 is a seal-end carton and includes a front panel 12, a rear panel 14 and two side panels 16, 18.

Disposed above the front and back panels 12, 14 are top flaps 20, and disposed below the panels are bottom flaps 22, each of the flaps 20, 22 being configured and dimensioned to close an open top or open bottom respectively, of the erected carton. The side panels 16, 18 have at their tops upper tabs 28 and at their bottoms lower tabs 30. The upper tabs 28 are adapted to fold inwardly underneath the top flaps 20, while the lower tabs 30 are adapted to fold inwardly and underneath the bottom flaps 22. The tabs 28, 30 are held in position by the flaps 20, 22, respectively, by glues or the like. The manufacturer's glue tab 32 extends along the free side of back panel 14 and is adapted to be glued or otherwise secured to the free side of the side panel 16 during finishing of the carton by box manufacturers so as to maintain the various panels 12, 14, 16, 18 in a three-dimensional construction of rectangular cross-section.

The carton blank 10 may be formed of any paperboard adapted to be printed with ink. For example, blister pack paperboard, clay coated newsback paperboard, or regular solid bleached sulphate (SBS) paperboard may be used. Preferably the paperboard has a clay coated surface to which ink can become tightly attached so that removal of the ink effects the removal of a slight amount of the clay——that is, the clay coating is fractured. A suitable paperboard is the blister pack paperboard commercially available under the trade name BLIS PAC from Federal Paperboard Co., Inc. of Riegelwood, N.C. 28456. The surface of the paperboard provides relatively easy release of any plastic overwrap film that has been adhered to it. The paperboard is a solid bleached sulphate (SBS) paperboard specifically designed for the blister packaging industry and meets the primary dual requirements of good printability and excellent heat sealing characteristics. It is double clay coated, low density paperboard and available in calipers of 0.016–0.028 inch thickness. The paperboard is preferably 0.016–0.018 inch thick and of appropriate size to be processed by the available printing equipment.

Referring now to FIG. 2 in particular, the surface of the blank destined to become the outer surface of the erected carton is printed with ink 40 to provide the ornamental appearance of the carton. Any low wax content ink may be employed for this purpose. The ink is preferably wax-free so as to allow good adhesion of the ink to heat-sealable coatings which may be applied thereto, with offset sheet-fed lithographic ink of the type commonly used in blister pack printing being preferred. Unfortunately, the low wax inks have unpredictable drying cycles and may never dry completely. Furthermore, these low wax inks do not allow testing to be conducted immediately after the sheets been printed, thereby causing quality control problems. Accordingly, it is preferred to use ultraviolet (U.V.) lithographic inks which rely on ultraviolet light to cure or dry them (that is, to change them from a liquid to solid). While these inks do not air dry, exposure to ultraviolet (U.V.) light effects substantially instantaneous curing so that the printed cartons may be tested immediately. These inks are commonly used in lithographic printing and may be obtained from the Acme Printing Inc., Co. of Chicago, Ill. A thin layer of UV transmissive varnish may be applied over the inked surface to provide additional scuff resistance to the U.V. ink and preserve it during subsequent carton handling. The varnish becomes in effect a part of the ink and is subsequently removed with the ink if and when the ink is removed.

The equipment used to apply the ink may depend upon the available equipment of the given carton manufacturer. Preferably an offset lithographic printing press with five printing stations and a press speed of approximately 4,500 impressions per hour is employed. A paperboard sheet, from which a plurality of carton blanks 10 will be die cut, is fed into the machine with various areas of the sheet receiving different colored inks at different stations of the press from conventional offset lithographic (planographic) printing plates. For example, with respect to the packaging shown in FIG. 6, the product name "IVY HILL" may be printed in black ink at one station, and the remainder of the carton printed in blue ink at a subsequent station.

Referring now in particular to FIG. 3, therein illustrated is the carton blank 10 having a pattern 42 of heat-sealable coating segments disposed on the exposed surface of the ink 40. The coating 42 is a commercially available transparent solvent-based heat-sealable coating such as that sold under the trade name 9094-008 by the Valspar Corporation of Pittsburgh, Pa. The coating is straw colored when wet, but colorless when dry; and the dried coating is sufficiently clear to allow the printed ink colors 40 therebelow to show through. Application of the purchased heat-sealable coating to the ink may be facilitated and improved by the addition of suitable viscosity modifiers to the purchased product according to techniques well recognized by the coating art.

While a transparent water-based acrylic heat-sealable coating (such as that available under the trade name 9489-011 from the Valspar Corporation) may be employed, a solvent based coating is superior because it dries more quickly then an aqueous coating and can be more rapidly activated using a lesser amount of heat. This enables the carton blanks to be manufactured more rapidly and later a more rapid adherence of the overwrap to the coated carton. The coating 42 may also be applied using screen printing instead of lithographic equipment, but this tends to be a slow operation not particularly well suited for in-line operation wherein the cartons are printed and coated in a continuous operation. Solvents and antifoaming agents are commonly added to a coating to be screen printed. Other printing machine may be used to apply the coating——for example, a gravure coater or a flexographic coater.

The coating is conveniently applied to the ink surface 40 of the carton blank 10 at the last printing station of the five printing station press, the last station having been converted to a coating station using a flexographic plate on a lithographic press. While the coating 42 may be applied on dry ink, it may also be applied to wet ink. In either instance screen printing is the preferred application method. The coated sheets are passed through a drying unit in order to hasten drying of any coating 42 as well as any wet ink 40. In order to allow for the slow drying of any solvent-based ink, the sheets are allowed to dry——for example, in short stacks (approximately 300–500 sheets per stack) for four days. The drying time may range up to several days depending upon the available temperature, moisture level, variables of raw materials, the number of sheets per stack, etc. The sheets are then die cut into folding carton forms having the outline of blank 10 of FIG. 1

It will be appreciated that different inks may be used and that such inks may be applied by a variety of different printing techniques well known to those in the carton printing field. Similarly, it will be appreciated that a variety of heat-sealable coatings may be utilized and these coatings may be applied and dried by a variety of different processes well known to those familiar with the coating art. It is important, however, that the bond between the ink 40 and the coating 42 immediately thereabove be appreciably stronger than the bond between the ink 40 and the carton 10 immediately therebelow.

The pattern 42 in which the heat-sealable coating is applied is designed to provide evidence of tampering with the carton should the pattern become visible. The communication of the pattern 42 may be graphic (for example, a picture of a skull and crossbones) or verbal (for example, the words "VOID" ——as illustrated——"TAMPERED" or "UNSAFE"). It is a primary feature of the present invention that the pattern 42 may be selected so as to communicate the fact of tampering even to first time purchasers of the product who are unfamiliar with the system and unable to distinguish between subtle differences in coloring, the absence of an overwrap, or a torn label resulting from tampering as opposed to merely rough handling during manufacture, storage or sale. Thus, communications such as "TAMPERED" or "DO NOT BUY" are preferred.

The intermediate composite represented in FIG. 3—— comprising the carton blank 10, the ink 40 and the coating 42 ——represents an intermediate useful in the manufacture of the finaltamper-evident packaging of the present invention, the intermediate typically being manufactured by a carton manufacturer for sale to a packager, who then erects the cartons from the carton blanks, fills the cartons with his product, closes the ends and then overwraps the closed carton with a transparent film.

Thus, after receiving the composite of FIG. 3, the packager, when it is time to erect the carton, folds it into the rectangular shape, folds up lower tabs 30 and closes bottom flaps 22 thereover. The product (such as a bottle of aspirin) is then inserted through the open top of the erected carton after which the top tabs 28 are folded down and secured in place by the top flaps 20. Securing means, such as hot melt or other glue, is used to ensure integrity of the closures.

Referring now to FIG. 4 in particular, the erected, filled and closed carton is then overwrapped with a transparent film 50. While an of the conventional transparent overwrap films which have the ability to heat seal well with the coating 42 may be employed as the overwrap film 50, preferred films are the two-sided acrylic heat-seal coated, biaxially oriented polypropylene commercially available under the trade name BICOR 220AB, 310AB and 380AB or the one-side PVDC, one side acrylic coated biaxially oriented polypropylene film available under the trade name BICOR ASB (both available from the Films Division of the Mobil Chemical Company). Both films are intended for general overwrap application on wrapping machines designed for use with polypropylene. The former affords excellent strength, moisture barrier and appearance; the latter has outstanding optical properties, exceptional dimensional stability and combines excellent machinability on the acrylic coated outer surface and excellent sealability and gas barrier properties on the polyvinylidene chloride coated inner surface.

An especially preferred transparent film 50 is a rigid polyvinyl chloride (PVC) film available under the trade name Temovir NRAM-V/33 available from FIAP USA of Wilmington, Del. The PVC film is preferably about 1 mil thick as lighter film becomes difficult to handle and heavier films are unnecessarily expensive. The PVC film readily adheres to the heat-sealable coating and yet will not adhere to the uncoated ink. Additionally, the PVC film withstands the subsequent thermal processing of the carton very well and can be removed from the uncoated ink in large sections without shredding. The aforenoted polypropylene films are less desirable as they tend to adhere to uncoated ink and to shred during removal.

The transparent film 50 requires only a level of transparency consonant with the purposes of the present invention——that is, a transparency extending over such a fraction of the film area that at least a substantial number of the inked carton surface portions overlaid with coating 42 are visible therethrough. Within these constraints, the transparent film 50 may be tinted or have portions thereof opaquely printed with ornamental, advertising, or informational matter.

If desired, a conventional tear strip (not shown) of pressure-sensitive heat resistant tear tape may be applied to the inside of the film, the inside being the side which will be adhered to the heat-sealable coating 42.

The coatings of the film 50 are primarily to enable the film to stick to itself so that a longitudinal seam may be formed and the ends folded over; thus these film coatings are intended primarily to seal to themselves. On the other hand, the heat-sealable coating 42 is intended to seal both with the ink 40 and the transparent film 50. It is a critical feature of the present invention that the bond of the heat-sealable coating 42 both with the ink 40 thereunder and the transparent film 50 thereabove be appreciably stronger than the bond between the ink 40 and the carton 10 or for that matter the rather weak bond, if any, which may form between the transparent film 50 and the ink 40 directly. Preferably the bonds between the heat-sealable coating 42 and the transparent film 50, on the one hand, and the heat-sealable coating 42 and the ink 40, on the other hand, are at least roughly equal, both being appreciably stronger than the bond between the ink 40 and the carton 10. The bonding of the overwrap film 50 to the heat-sealable coating 42 is accomplished by the application of heat and/or pressure to the overwrap film 50. While the temperatures and pressures required will vary with the particular overwrap film 50 and heat-sealable coating 42, generally pressures of about 10–20 p.s.i. and temperatures of 200°–300° F. (preferably about 270° F.) for approximately 1–2 seconds suffice. The temperature and pressure are uniformly applied over the entire surface of the overwrap film, or at least that portion of the film surface overlying the heat-sealable coating. If desired, the pressure need not be externally applied, but may be produced through the use of a heat-shrinkable overwrap film 50 which produces the requisite pressure by shrinking about the overwrapped carton during the application of heat thereto. The heat may be applied by various conventional means such as conduction, convection, or radiation.

While polypropylene, and especially biaxially oriented polypropylene, and PVC are preferred overwrap materials, other materials well recognized in the overwrap art may also be used. Some of these materials may be used on the same overwrap equipment as polypropylene, while others, such as cellophane, may require different or modified overwrap equipment.

Referring now in particular to FIG. 6, therein illustrated is an overwrapped carton comprising a white surface of paperboard 10 printed all over with blue ink 40, except where black ink in the form "IVY HILL" is disposed, a transparent, almost unnoticeable pattern 42 of heat-sealable coating disposed over the ink 40 (here exaggerated for illustrative purposes), and a transparent overwrap 50 overwrapping all.

Figure 7:
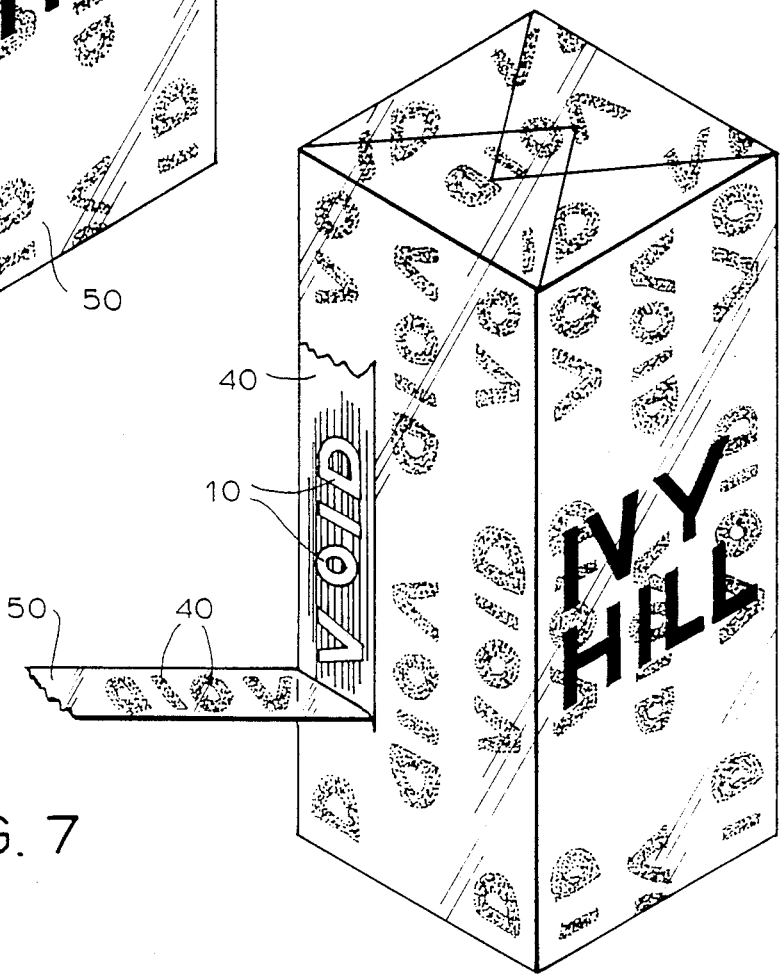
FIG. 7 is an isometric view similar to FIG. 6, but showing a portion of the carton in a tampered state.

Referring now to FIGS. 5 and 7 in particular, upon removal of a portion of the transparent film 50, as might occur during tampering, the transparent overwrap portion being removed carries with it the underlying pattern of heat-sealable coating 42 and the portion of the ink 40 thereunder to reveal the white outer surface of the carton 10. The white surface of the carton 10 stands out clearly against the blue background of the ink 40 so that the potential purchaser sees the word "VOID" in white against the blue background. As earlier noted, other words of caution or graphic representations may be used to communicate to the potential purchaser that the packaging has been tampered with.

As earlier noted, the carton 10 is generally formed of paperboard having a clay coating on the outer surface thereof. This clay is typically white, and it is the clay which is typically exposed as the ink 40 is torn away from the paperboard of the carton, along with the overwrap film 50 and heat-sealable coating 42. Where the ink 40 is strongly adherent to the clay surface of the carton 10, the clay coating may separate, an outer portion being removed from the carton along with the ink and an inner portion remaining on the paperboard fibers, visible to the user. In the instances where the paperboard lacks any clay coating and the ink 40 is strongly adherent to the outer surface of the paperboard of carton 10, some tearing of the paperboard fibers may also occur. While this in no way detracts from the tamper-evident nature of the packaging, it can present a more unsightly open product for the purchaser, makes it harder to remove the overwrap film, and, depending upon the degree of tearing, can result in a blurred image of the message being communicated to the purchaser. Accordingly, it is preferred that the ink 40 and paperboard 10 be selected to provide for a relatively clean removal of the ink from the paperboard.

It will be appreciated that in the first embodiment of the present invention described above, the overwrap film is secured to the ink in differentially adherent patterns through the use of an intermediate pattern of heat-sealable coating. Thus, the film 50 is tightly adherent to the ink 40 where the pattern of heat-sealable coating 42 is present and is not at all, or only slightly, adherent in the pattern created by the absence of the heat-sealable coating 42. Also within the scope of the present invention are other means of achieving differentially adherent patterns between the transparent film overwrapping the closed carton and the ink secured to the outer carton surface.

While the first embodiment is described above in terms of a heat-sealable coating 42 which is applied to the inked outer surface of the carton prior to application of the overwrap film 50, the heat-sealable coating 42 may alternatively be applied directly to the overwrap film 50. Referring now to FIG. 25, the overwrap film 50 can be printed with a selected pattern of the heat-sealable coating 42. The subsequent uniform application of heat and pressure to the film 50 (as illustrated by the facing arrows) causes the heat-sealable coating 42 on the film 50 to bond with the ink 40 in the selected pattern. While this variation of the first embodiment produces the desired evidence of tampering with the carton, other problems may arise. For example, if the overwrap film 50 is not applied to the carton in such a manner as to effect the desired registration of the patterned heat-sealable coating 42 on the overwrap film 50 with the desired locations of the outer carton surface, removal of the overwrap (and hence the heat-sealable coating pattern) may effect removal of ink which should be left on the carton surface (for example, instructions on how the product is to be used, promotional matter, and the like). The same is true if the coating is applied in a random pattern.

In this variation of the first embodiment, PVC overwrap film in roll form is coated with a solvent based coating. The coated film is adhered to a paperboard carton printed with U.V. ink and optionally coated with a U.V. varnish, with the coated side of the overwrap film in contact with the ink/varnish paperboard surface. Light hand pressure and a temperature of 300° F. for 3 to 6 seconds suffice to adhere the coated film to the printed paperboard so that removal of the overwrap film from the printed paperboard also removes the ink/varnish from the paperboard. An advantage of this variation of the first embodiment is that the cartons may be conventionally produced and printed.

Referring now to FIGS. 8–10, therein illustrated is a second embodiment of the present invention wherein the differentially adherent patterns between the transparent overwrapped films 50 and the ink 40 are achieved by use of a uniform heat-sealable coating 42' and the selective application of heat and pressure to produce the desired pattern.

Referring now to FIG. 8 in particular, the composite of FIG. 2——comprising a carton 10 and ink 40——has applied thereto a uniform layer 42' of a heat-sealable coating. A transparent film 50 is overwrapped about the erected, filled and closed carton in the same manner as in the first embodiment.

Referring now to FIG. 9, heat and pressure are then selectively applied to the overwrap film 50 so as to activate the heat-sealable coating 42' therebelow only in particular areas comprising the desired pattern. Thus, the desired pattern of heat-sealable coating 42' bonds to the overwrap film 50 only in the given pattern. The pressure, temperature and time required to achieve the necessary activation of the heat-sealable coating portions will, of course, be a function of materials used. Generally, a relatively swift kiss with a heated embossing die suffices, the optimum parameters for the operation being easily determined by conventional experimentation with the aforesaid parameters. The selective application of heat and pressure to activate the coating 42' in the desired pattern may result in slight surface depressions in the desired pattern on the upper surface of the overwrap film 50, as shown to a greatly exaggerated degree in FIGS. 9 and 10 for expository purposes.

Referring now to FIG. 10, upon removal of the overwrap film 50, the portions of the heat-sealable coating 42' bonded thereto and the underlying portions of ink 40 are removed therewith. The result is substantially the same as that shown in FIG. 7 except that, in the areas outside of the desired pattern, instead of the ink surface 40 being exposed by removal of the overwrap film 50, the remaining portions of the heat-sealable coating 42' are disposed on the outer carton surface, the ink 40 being readily visible through the transparent coating 42', however. As in the first embodiment, it is critical that the portions of the heat-sealable coating 42' actuated by the heat and pressure bond to the ink 40 on the one hand, and to the transparent film 50, on the other hand, with appreciably greater strength than the ink 40 bonds to the outer surface of the carton 10 or the transparent film 50 bonds to the unactuated portions of the heat-sealable coating 42'.

Referring now to FIG. 26, just as in a variation of the first embodiment the pattern of heat-sealable coating 42 is applied to the overwrap film 50 initially rather than to the inked outer surface of the carton, in a variation of the second embodiment the uniform layer of heat-sealable coating 42' may be applied to the overwrap film 50 rather than the inked outer carton surface. The subsequent selective application of heat and pressure to the overwrap film 50 (as illustrated by the arrows) causes the heat-sealable coating 42' on the film 50 to bond in a selected pattern with the ink 40 of the outer carton surface.

Referring now to FIGS. 11–13, therein illustrated is a third embodiment of the present invention wherein the differentially adherent patterns between the transparent overwrap film 50 and the ink 40 are achieved exclusively through the selective application of heat and pressure without the use of a heat-sealable coating applied either in a pattern 42 or a uniform layer 42' intermediate the overwrap film 50 and the ink 40.

Referring now to FIG. 11 in particular, therein illustrated is the composite of FIG. 2——comprising the carton 10 and the ink 40——with a transparent film 50 overwrapping the erected, filled and closed carton. For this embodiment, the transparent film 50 is preferably the aforementioned one side PVDC, one side acrylic coated biaxially oriented polypropylene film (available under the trade name BICOR ASB from the Films Division of Mobil Chemical Company.) While such a film tends to be more expensive than a two-sided acrylic coated polypropylene film, the extra cost is usually offset by the savings resulting from the material and application costs eliminated by dispensing with the separate heat-sealable coating.

Especially useful in the practice of the third embodiment are those inks, typically those which contain high solvent residues, which exhibit certain characteristics of heat-sealable coatings and thus do not require that a heat-sealable coating be applied intermediate the film and ink.

Referring now to FIG. 12, the selective application of heat and pressure to the overwrap film 50 causes the overwrap film to bond with the underlying ink 40 in the desired pattern. The pressures, temperatures and times required to achieve the necessary bonding will, of course, be a function of the materials used, as in the second embodiment.

Referring now to FIG. 13, upon removal of a portion of the transparent film 50, the underlying portions of ink 40 bonded thereto by the selective application of heat and pressure are now removed with the overwrap portion to reveal a deinked carton surface 10 in the desired pattern. The tampered carton according to this embodiment is substantially similar to that shown in FIG. 7, except for the absence of any separate and distinct heat-sealable coating 42.

In the second and third embodiments, the selective application of heat and pressure to selectively bond the film to the ink in differentially adherent patterns may be performed either during and as part of the overwrapping step or, if more convenient, at a later time.

Each of the embodiments of the present invention has its own advantages and disadvantages rendering it more or less suitable for particular applications. For example, in the first embodiment, the carton manufacturer applies the coating in a predetermined pattern defining the message which will be communicated to the potential purchaser by a tampered package. On the other hand, the packager may utilize the intermediate provided by the carton manufacturer with comparatively minor modification of his ordinary overwrapping equipment, and yet secure for himself the benefit of tamper-evident packaqing. The second embodiment provides the packager with an opportunity to decide for himself the language of the warning to be evidenced by the tamper-evident packaging, but he will generally have to modify his conventional overwrapping equipment substantially in order to provide for the selective application of heat and pressure. The third embodiment offers advantages and disadvantages substantially similar to the second embodiment except that there is also a possibility of reduced costs (due to the absence of a heat-sealable coating) and the possibility of inferior bonding between the transparent film and ink (due again to the absence of heat-sealable coating.) In any of the three embodiments auxiliary equipment may be used instead of modifying conventional equipment.

In the first embodiment described above the message which will be communicated to the potential purchaser by the tampered or opened package is substantially invisible to the potential purchaser in the untampered and unopened package. However, if the package is held just right (that is, at certain angles to certain types of light), it may be possible for a discerning viewer to faintly see the warning message even on the untampered and unopened package. The message thus viewed is, however, so faint, that it is unlikely that the potential purchaser would, as a practical matter, be dissuaded from making the purchase. On the other hand, the appearance of even a faint message may be slightly troublesome to some potential purchasers and is in any case undesirable from an aesthetic point of view. Accordingly, as the faint image found in the untampered and unopened carton is believed to result from the patterning of the heat-sealable coating 42 in the first embodiments of FIGS. 1–7, a fourth embodiment of the present invention utilizes a uniform (i.e., non-patterned) heat sealable coating 42′ like the second embodiment of FIGS. 8–10. On the other hand, the fourth embodiment is similar to the first embodiment in that the bonding of the ink 40, the heat-sealable coating 42 or 42′ and the overwrap film 50 is accomplished through the uniform application of heat and pressure to the overwrapped carton. This represents an additional advantage of the fourth embodiment as standard equipment for applying overwrap film is much more easily adapted for the uniform application of heat and pressure to any given carton face than it is for the selective application of heat and pressure——that is, the application of heat, pressure or a combination of heat and pressure in a selected pattern on a given carton face. The ability to use standard commercial overwrap equipment with only minor modifications is an especially attractive feature to those already possessing such equipment and not wishing to make a substantial further investment in modifying the equipment to provide the selective application of heat and pressure. Thus the fourth embodiment combines the advantages of the first and second embodiments albeit at a slightly greater cost in materials because, in addition to a uniform transparent heat-sealable coating layer 42′, there is also the additional cost of a patterned release coating layer as explained hereinbelow.

There are three variations constituting the fourth embodiment. In the first variation illustrated in FIG. 22, the pattern of transparent release coating 51 is interposed between the ink layer 40 and the transparent heat-sealable coating layer 42′; in the second variation illustrated in FIG. 23, the pattern of transparent release coating 51 is disposed intermediate the transparent heat-sealable coating layer 42′ and the transparent overwrap film 50; and in the third variation illustrated in FIG. 24, the pattern of release coating 51 is interposed intermediate the carton outer surface 10 and the ink layer 40.

In each variation an erected, filled and closed carton has an outer surface layer 10. An ink layer 40 overlies at least a portion of the closed carton and is disposed about the carton outer surface layer 10 so as to be visible from outside the closed carton. The ink layer 40 is adapted to be bonded to an underlying layer other than a release coating through the application of heat and pressure. A transparent overwrap film layer 50 overwraps at least a portion of the closed carton and is disposed about the ink layer 40. The overwrap film layer 50 is adapted to be bonded to an underlying layer other than a release coating. The overwrap film layer 50 secures the overwrapped portion of the closed carton against tampering and must necessarily be removed at least in part from that portion of the closed carton in order to effect tampering. A release coating layer 51 defines a pattern of release coating disposed intermediate a pair of the aforementioned three layers 10, 40 and 50. The release coating layer 51 either precludes removal of a selected pattern of an underlying ink layer 40 with the removal of an overlying overwrap film layer or enables removal of a selected pattern of an overlying ink layer 40 with removal of an overlying overwrap film layer, in both instances to reveal thereby a desired pattern evidencing tampering.

In both the first and second variations, the pattern of release coating 51 is disposed intermediate the ink layer 40 and the overwrap film layer 50 and precludes removal of an underlying pattern of the ink layer 40 with the overwrap film and heat-sealable layers 50, 42′ to reveal a desired pattern of deinking, the pattern of release coating therefore being a negative image of the desired pattern of deinking. In the third variation, the pattern of release coating 51 is disposed intermediate the carton outer surface 10 and the ink layer 40 and enables removal of an overlying pattern of the ink layer 40 with the overwrap film and heat-sealable layers 50, 42′ to reveal a desired pattern of deinking, the pattern of release coating therefore being a positive image of the desired pattern of deinking.

Thus, in each variation of the fourth embodiment the release coating 51 is applied in a pattern which is a negative or positive image of the message used to communicate tampering by deinking portions of the ink layer 40. In the first and second variations shown in FIGS. 22 and 23, the transparent release coating 51 is applied as a negative image of the deinked message used to communicate tampering to the potential purchaser because the presence of the release coating 51 prevents the underlying portion of the ink layer 40 from being deinked when the overwrap film 50 is removed from the carton (taking with it the heat-sealable coating layer 42′ and the portions of the ink layer 40 not underlying the pattern of release coating 51). In the third variation of the fourth embodiment shown in FIG. 24, the release coating is applied as a positive image because the presence the release coating 51 permits the overlying portion of the ink layer 40 to be removed or deinked from the carton outer surface with the overwrap film 50 and heat-sealable coating 42′ to provide the deinked message evidencing tampering.

Referring now to the first variation illustrated in FIG. 22, FIG. 22A shows the outer carton surface 10, FIG. 22B shows the application of the ink layer 40 thereto, FIG. 22C shows the application of a pattern of transparent release coating 51 thereto (in a negative image of the message to be communicated), FIG. 22D shows the application of a uniform layer of transparent heat-sealable coating 42′ thereon (with this layer 42′ further extending into the gaps formed by the pattern of release coating 51 and eventually entering into bonding contact with the ink layer 40), and FIG. 22E shows the uniform application of a transparent overwrap film 50 thereon. FIG. 22F shows the lifting of the overwrap film 50 from the carton outer surface 10, the overwrap film 50 taking with it the heat-sealable coating layer 42′ bonded thereto and the portions of the ink layer 40 bonded to that heat-sealable coating layer 42′, thereby to leave a deinked pattern on the outer carton surface 10 forming the desired message.

Referring now to the second variation illustrated in FIG. 23, FIG. 23A shows the outer carton surface 10, FIG. 23B shows the application of an ink layer 40 thereto, FIG. 23C shows the application of a uniform layer of transparent heat-sealable coating 42′ thereto, FIG. 23D shows the application of a pattern of transparent release coating 51 thereto (in a negative image of the message to be communicated), and FIG. 23E shows the uniform application of transparent overwrap film 50 thereto (with the overwrap film 50 entering into the gaps formed by the pattern of release coating 51 and eventually entering into bonding contact with the heat-sealable coating 42′). FIG. 23F shows the lifting of the overwrap film 50 from the carton outer surface 10, the overwrap film 50 taking with it the underlying portions of the heat-sealable coating layer 42′ bonded to that overwrap film 50 and the portion of the ink layer 40 bonded to those heat-sealable coating portions, thereby to leave a deinked pattern on the outer carton surface 10 forming the desired message.

It should be appreciated that the indentations or depressions in the outer surface of the overwrap film layer 50 shown in FIGS. 23E and 23F (aligned with the gaps in the pattern of release coating 51) are greatly exaggerated in depth. In fact, these depressions, caused by the overwrap film 50 entering into the gaps, are barely discernable either visually or tactilely and are illustrated in exaggerated form in the drawing for expository purposes.

Referring now to the third variation illustrated in FIG. 24, FIG. 24A shows the outer carton surface 10, FIG. 24B shows the application of a pattern of release coating 51 thereto, FIG. 24C shows the application of an ink layer 40 thereto (with the ink layer 40 entering into the gaps formed by the pattern of release coating 51 and eventually entering into bonding contact with the outer carton surface 10), FIG. 24D shows the uniform application of a transparent heat-sealable coating layer 42' thereto, and FIG. 24E shows the uniform application of a transparent overwrap film 50 thereon. FIG. 24F shows the lifting of the overwrap film 50 from the carton outer surface 10, the overwrap film 50 taking with it the heat-sealable coating layer 42' bonded thereto and the portions of the ink layer 40 bonded to that heat-sealable coating layer 42' and overlying the pattern of release coating 51, thereby to leave a deinked pattern on the outer carton surface 10 forming the desired message.

The carton of the fourth embodiment may be manufactured using the equipment described in connection with the first embodiment, but with an additional station being added or additional equipment used to provide the desired pattern of release coating 51 at the appropriate stage. The release coating 51 is preferably in the form of a varnish to facilitate application thereof, a quick drying varnish such as a UV varnish being preferred. Infrared heat may be employed to accelerate drying of a non UV varnish. Where the ink used for ink layer 40 is UV ink, in the first and second variations, the release coating 51 overlying the ink layer 40 should be UV transmissive to permit curing of the ink by ultraviolet radiation.

The release coating 51 is necessarily transparent in the first and second variations of the fourth embodiment to permit viewing of the underlying ink layer 40. On the other hand, the release coating 51 may be transparent or opaque in the third variation as it does not interfere in either case with viewing of the overlying ink layer 40. It will be appreciated that the release coating 51 is not disposed in those areas of the carton which will eventually need to accept glue, as required in the conventional manufacture and sealing of folded cartons, as the presence of the release coating may interfere with the desired operation of the glue.

For the fourth embodiment employing a release coating, a preferred paperboard is a solid bleached sulfate paperboard specifically designed for the manufacture of folding cartons and meeting the primary requirements of good printability and folding characteristics, commercially available under the trade name ValuCoat (from International Paper Co. of Park Ridge, N.J.). The surface of the paperboard is clay coated to provide relatively easy release of any plastic overwrap film adhered to it. The paperboard is preferably of low density, about 0.016–0.020 inch thick, and of an appropriate size to be processed by available printing equipment. The ink, which provides the ornamental appearance of the carton or areas of solid color specifically intended for location of the latent message to be revealed by tampering or opening of the package, is preferably ultraviolet (UV) ink to permit almost total instantaneous curing or drying thereof and promote good adhesion of the ink to any heat sealing coating which may be applied thereto. A preferred ink is an offset sheet-fed lithographic UV ink of the type commonly used to print folding cartons and available under the trade name Acraset TRP ink (from the Acme Printing Ink Company of Chicago, Ill.). A preferred release coating varnish is available under the trade name Acraset TRP Varnish (from the same Acme Printing Ink Company). A preferred heat-sealable coating is the previously mentioned transparent water-based acrylic heat sealable coating available under the trade name 9489-011 (from Valspar Corporation of Pittsburgh, Pa.). The preferred overwrap film is a rigid polyvinyl chloride (PVC) film available under the trade name Temovir (from FIAP U.S.A. of Wilmington, Del.).

Bonding of the outer carton surface 10 and the ink 40 typically occurs during the ink drying stage. Bonding of the overwrap film 50, the heat sealable coating 42' and the ink 40 is effected by the uniform application of heat and pressure appropriate to the materials being used. For example, heat of about 300° F. for about 6–60 seconds (preferably 30–60 seconds) in combination with an applied pressure (equivalent to hand pressure) suffices. Variations in the mentioned temperature, pressure and time will be readily apparent to those skilled in the art as a function of the materials used, the available equipment and the like. It has been found that improved results are obtained in particular instances if the carton, immediately after removal from the heating, is burnished to create intimate contact between the various layers 50, 42', 40 and 10 and eliminate any air bubbles trapped between the layers which might interfere with adhesion. The burnishing may consist simply of rubbing the outer surface of the overwrap film with a piece of soft cloth similar to cheesecloth.

In the "uniform application of heat and pressure", as that term is used in the description of the first and fourth embodiments, generally the heat and pressure will be applied uniformly to the overwrap on all sides (including ends) of the overwrap carton, but this is not necessarily the case. For example, the heat and pressure may be uniformly applied only on certain panels or certain flaps and, indeed, may be applied only in particular bands extending across or along one or more sides. The critical factor is that the heat and pressure are applied uniformly both to the areas of the overwrap film overlying the heat-sealable coating and to at least some of the adjacent areas of the overwrap film not overlying the heat-sealable coating. For example, only particular sides or ends of the overwrap carton may be passed by a heat source. Where the message intended to be communicated to the purchaser is arranged in parallel bands extending about an overwrapped carton, the pressure may be uniformly applied only in those bands, the pressure affecting both the areas in the band overlying the heat-sealable coating and those areas in the band not overlying the heat-sealable coating. For the purposes of the present specification and the appended claims, all of these alternatives are encompassed within the general terminology of "uniform application of heat and pressure" as used in conjunction with the first and fourth embodiments of the present invention.

In the "selective application of heat and pressure", as that term is used in the description of the second and third embodiments, the heat may be applied generally uniformly to the overwrap film and the pressure selectively applied in a given pattern, as by the use of a relief roller or die. Alternatively, the pressure may be applied generally uniformly to the overwrap film and the heat selectively applied in a given pattern, as by the use of laser beams to produce the selective heating. Where the heat is being applied generally uniformly, it may be applied by ambient temperature; and where the pressure is being applied generally uniformly, it may be applied by ambient atmospheric pressure. For the purposes of the present specification and the appended claims, all of these alternatives are encompassed within the general terminology of "selective application of heat and pressure" as used in conjunction with the second and third embodiments of the present invention.

While the cost of the overwrapping film and any heat-sealable coating employed in the practice of the present invention are insubstantial on a per carton basis, the sheer volume of cartons which may be rendered tamper-evident according to the present invention makes any potential saving on the cost of materials worthwhile. The fifth embodiment requires use of the overwrap film only on the working ends of the cartons——that is, the parts of the carton which open and close——plus short contiguous portions of either two or four face and/or side panels. Where the carton has two working ends, the film must be applied to both end panels, plus the short contiguous portions of either two or four adjacent face and/or side panels, in order to impart the tamper-evident property. Both the end or ends of the carton, plus those short contiguous portions which will be covered by the film, are printed with ink and have the film overwrap secured to the ink in selectively differential adherent patterns according to one of the first four embodiments of the present invention. Removal of the film overwrap from the carton also removes the ink in one of the patterns to reveal the desired pattern of deinked outer carton surface and thereby evidence tampering with the package.

Referring now to FIGS. 14–18, therein illustrated are various types of cartons according to the fifth embodiment of the present invention. Elements in these cartons having equivalent structure or performing equivalent functions will be identified by corresponding reference numerals.

Figure 14:
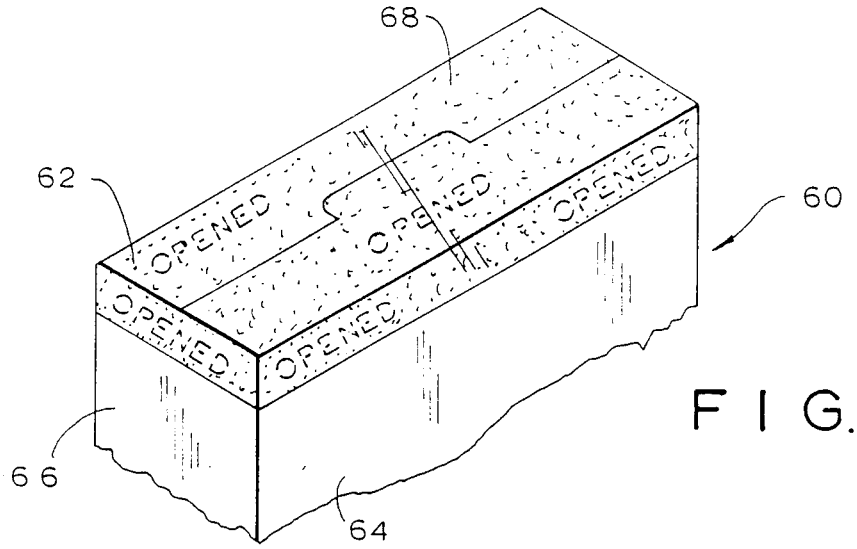
FIG. 14 is a fragmentary isometric view of an economy seal end carton according to the fifth embodiment of the present invention, with the end cap extending over the end panel and contiguous portions of the face and side panels.

FIG. 14 illustrates an economy seal end carton generally designated 60 having a pair of opposed end panels 62, a pair of opposed face panels 64 (i.e., the face and rear panels), and a pair of opposed side panels 66. Each end cap 68 of film covers an entire end panel 62 as well as the contiguous portions of the face and side panels 64, 66. A similar end cap (not shown) is disposed on the opposite end panel (not shown) and the contiguous portions of the face and side panels. Latent warning messages (e.g., "OPENED", "VOID" or "TAMPERED") are disposed on the end panels and on the contiguous portions of the face and side panels covered by the film end caps 68. The extent to which the end caps 68 extend over the face and side panels 64, 66 is determined both by the need for a good, effective seal between the film 68 and such panels 64, 66, by the need for adequate surface area on the overwrapped portions 64, 66 to provide easily readable, attention attracting messages indicating possible tampering with the carton 60 (should that be the case), and by the need to create confidence in the mind of the consumer regarding the tamper-evident property of the carton. Within these constraints, the contiguous portions of the panels 64, 66 overlaid by the end cap 68 should be short, preferably less than 50% of the length of the panels containing the contiguous portions.

Figure 15:
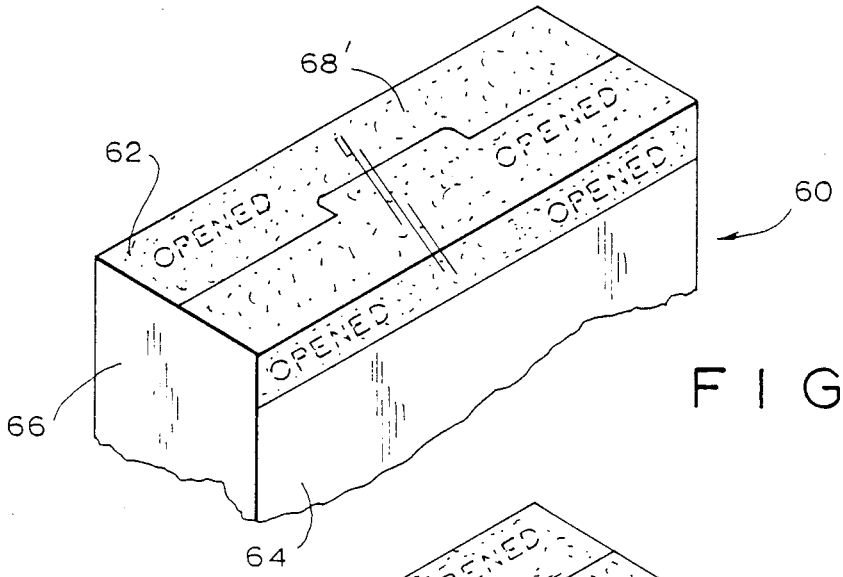
FIG. 15 is a fragmentary isometric view of an economy seal end carton according to the fifth embodiment, with the end cap extending over the end panel and the contiguous portions of the face panels.
Figure 16:
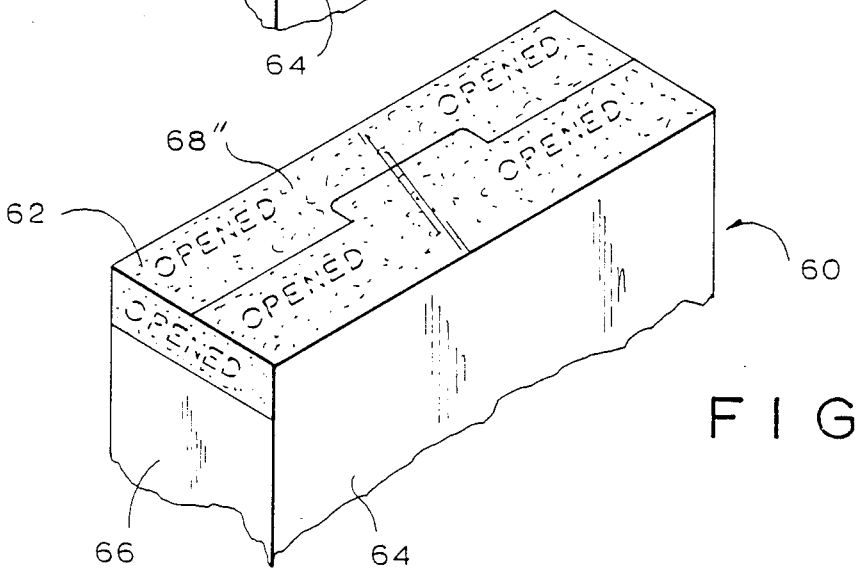
FIG. 16 is a fragmentary isometric view of an economy seal end carton according to the fifth embodiment, with the end cap extending over the end panel and the contiguous portions of the side panels.

Referring now to FIG. 15, therein illustrated is an economy seal end carton, generally designated 60, similar to that shown in FIG. 14. However, the end cap 68' covers an end panel 62 in its entirety and only the contiguous portions of the opposed face panels 64, and not the contiguous portions of the opposed side panels 66. Referring now to FIG. 16, therein illustrated is an economy seal end carton according to the fifth embodiment of the present invention, generally designated 60, similar to that illustrated in FIG. 14. However the end cap 68'' covers the end panel 62 in its entirety and only the contiguous portions of the opposed side panels 66, and not the contiguous portions of the opposed face panels 64.

While FIGS. 14–16 illustrate the economy sealed cartons 60 as having the opposed end panels 62 meeting and overlapping along the centerline of the carton end, the overlap of the two end panels 62 tends to cause the overlapped end panel to be spaced from the end cap 68, 68', 68''. Accordingly, it is preferred to have the end panels 62 meet and overlap to one side of the center line of the end cap, and preferably relatively closely adjacent to one of the opposed face panels 64.

Referring now to FIG. 17, therein illustrated is a telescope carton (of the type commonly used for wooden matches), generally designated 70. As illustrated, each end caps 68 cover an end panel 62 in its entirety and the contiguous portions of the face and side panels 64, 66 for maximum protection, as in the case of FIG. 14 for the economy seal end carton. However, if desired, the telescope carton 70 may have end cap cover only the end panel 62 in its entirety and only the contiguous portions of the face panels 64 or the end panel 62 in its entirety and only the contiguous portions of the side panels 66, as in FIGS. 15 and 16, respectively, for the economy seal end cartons 60.

Referring now to FIG. 18, therein illustrated is a fifth panel carton generally designated 80——that is, a carton with an integral riser 82 which provides additional display space when lifted (as illustrated). Each end cap 68 covers an end panel 62 in its entirety and the contiguous portions of the face and side panels 64, 66 for maximum protection, as in the case of FIG. 14 for the economy seal end carton. However, if desired, the fifth panel carton 80 may have each end cap 68 cover only the end panel 62 in its entirety and the contiguous portions of the face panels 64 (and not the contiguous portions of the side panels 66) or the end panel 62 in its entirety and the contiguous portions of the side panel 66 (and not the contiguous portions of the face panels 64), as in FIGS. 15 and 16, respectively, for the economy seal end cartons 60.

The fifth panel 82 is lifted from the central portion of the top face panel, as illustrated in FIG. 18, during setup of the carton for display. Thus where the end caps 68 cover the end panels 62 and the contiguous portions of the face panels 64, the fifth panel 82 must be sufficiently narrow so as not to interfere with the application of the film end caps 68. No such restriction is imposed where the end caps 68 cover the end panel and only the contiguous portions of the side panels 66.

It will be appreciated that removal of the adhered film of the end cap 68 may be facilitated by the inclusion of a string or tear strip (not shown) running longitudinally or transversely under the film.

The machine for dispensing, applying and adhering the film overwrap of the end cap 68 to the carton 60, 70, 80 includes an infeed for filled, sealed cartons. The machine dispenses a suitable length of film and applies it at each end first to an end panel and then to the contiguous portions. Alternatively, at each carton end the machine may apply the film first to one contiguous portion, then to the end panel, next to the opposite contiguous portion, and optionally to another pair of opposed contiguous portions. The machine preferably applies a length of film to each end of the carton simultaneously, although it may alternatively be applied sequentially to the ends of the carton. Where the end cap will involve application of the film to the end, face and side panels, the corners of the film are folded in by the machine to produce a relatively smooth end cap, even on the contiguous portions. The machine next applies heat and/or pressure as necessary to cause the film to adhere to the carton over the film's entire area and finally discharges the partially overwrapped cartons from the machine for accumulation and casing.

Recapitulating, the fifth embodiment of the present invention is directed to a product which is only partially overwrapped with the overwrap film to reduce substantially the quantity of film utilized, thereby obtaining an equivalent tamper-evident property at a reduced film cost. In addition to saving the cost of the film intermediate the end caps (which depending on the relative lengths of the carton and the contiguous portions, could approach 100%), there is also less film used in forming each end cap vis-a vis a standard overwrap due to a reduction in the amount of overlapping over the end panel. Where the fifth embodiment utilizes a heat-sealable coating, as in the first, second and fourth embodiments of the present invention, then there may also be a corresponding reduction in the quantity of heat-sealable coating utilized and a consequent reduced heat-sealable coating cost. Where the fifth embodiment is made according to the third embodiment of the present invention which employs no heat-sealable coating, then obviously this additional saving (beyond the saving in film cost) is not obtained. Thus, the fifth embodiment of the present invention enables economies of material to be effected through the use of end caps which render the packaging tamper-evident although the film overwrap does not completely cover the entirety of the exposed surface of the carton.

Figure 19:
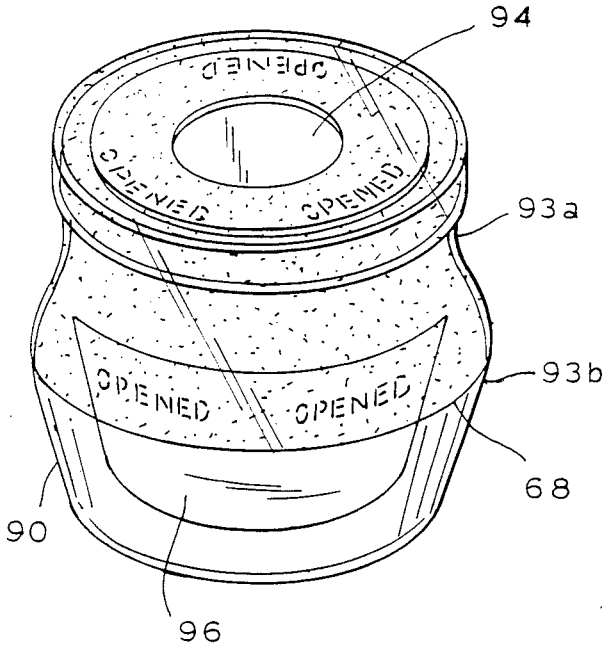
FIG. 19 is a front elevation view of a jar having an end seal according to the fifth embodiment.
Figure 20:
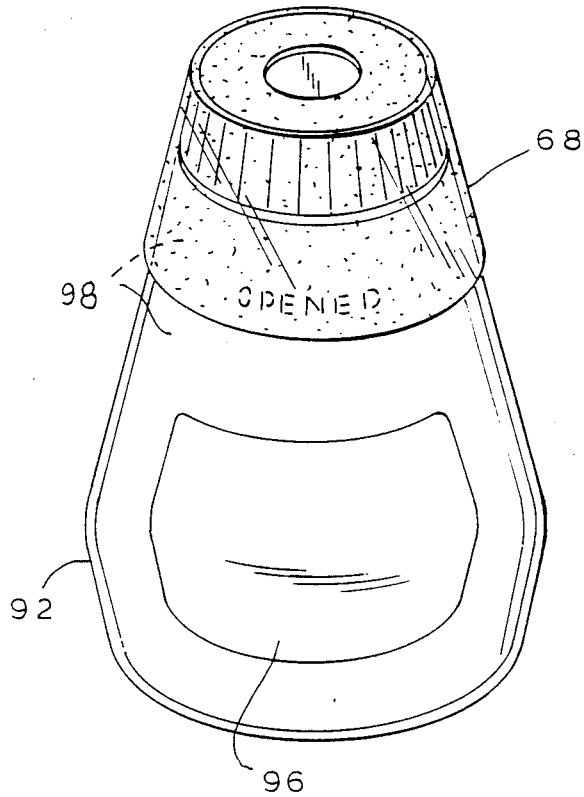
FIG. 20 is a front elevation view of a bottle having an end seal according to the fifth embodiment.

While the principles of the present invention have been expounded in the context of a box like carton of paper or paperboard, clearly the principles of the present invention have wider applicability and are generally useful in the packaging art. For example, referring now to FIGS. 19 and 20 therein illustrated are packages according to the fifth embodiment which are neither box like nor cartons formed substantially of paper or paperboard. The package may be a jar 90 as illustrated in FIG. 19, a bottle 92 as illustrated in FIG. 20 or the like. The package 90, 92 may have a top label 4 (as illustrated in FIG. 19), a side label 96 (as illustrated in FIG. 19), a neck label (not shown), a COmbination of these labels, or no label at all but simply a portion 98 of its outer surface printed with ink, for example, by flexographic or gravure techniques (as illustrated in FIG. 20). The package may be made of any suitable material, such as glass or plastic, which will accept a label, or in the case of a package which will be directly imprinted with ink and not have a label thereon, any suitable material which will hold ink satisfactorily. Some materials will be suitable for direct imprinting, and others not; for example, polypropylene tends not to retain the ink sufficiently, whereas polyethylene terephthalate (PET) generally holds the ink adequately. Where the package is substantially formed of a material other than paper or paperboard and has a label, the label may be formed of paper or paperboard. In any case, the label acts as an inked outer surface of the package.

Referring now to FIG. 19, the package 90 may be of a design having one or more reduced width segments 93——for example, a first reduced width segment **93*a* intermediate the end panel 94 and the label 96**, and a second reduced width segment 93*b* intermediate the central bulge and the other end panel—— so that a heat shrinkable end cap 68 may be easily applied thereto and secured against subsequent removal and replacement. On the other hand, referring now to FIG. 20, the present invention also permits the use of a package 92 having a conical configuration of the type which previously resisted heat-shrinkable bands as the heat-shrinkable band tended to slide off the package during the heat-shrinking operation. This new capability is made possible because the adherence of the overwrap film 68 to the package outer surface, or to the label comprising a part of the package outer surface (in the manner of FIG. 19), maintains the overwrapped film 68 in appropriate juxtaposition during the heat shrinking process. Thus, in formulating the packaging 92 according to the first, second or fourth embodiments of the present invention, it may be desirable to select the activation temperature and time for the heat sealable coating relative to the activation temperature and time of the heat-shrinkable film 68 such that the heat-sealable coating develops sufficient tack to prevent upward shrinkage of the band prior to the time that the heat-shrinkable film would otherwise begin to shrink away from the package. To this end, appropriate heat-shrinkable films and heat sealable coatings may be selected and appropriate temperature profiles established in the heat shrink tunnel by those skilled in the art with minimal experimentation.

Referring now to FIG. 21, the heat-shrinkable overwrap film 68 may also be applied as an end cap to a package 98 which is a conventional paperboard carton having, for example, an economy seal end which may or may not have printing thereon.

A preferred material for the heat-shrinkable end cap is available under the trade name SkinTight Seamed PVC (from Gilbreth International Corporation of Bensalem, Pa.), the preferred grade being No. 7150, 1.5 mil, seamed, clear style. The heat-shrinkable overwrap band material is conveniently obtainable in a continuous tubular form, with the diameter of the tube being selected for the appropriate package.

As earlier noted, the heat-shrinkable film may be used to apply the uniform pressure in the first or fourth embodiments. However, where the uniform pressure applied by the heat shrinkable film during heating thereof is inadequate to effect the necessary bonding between the film and the inked outer carton surface, external uniform pressure may be used to supplement whatever uniform pressure is exerted by the shrinking film. It will be further appreciated that a heat-shrinkable overwrap film 68 may be employed in the second and third embodiments of the present invention where the pressure applied by the shrinking film 68 is itself inadequate to effect bonding between the overwrap film and the inked outer carton surface so that additional external pressure must also be applied. The additional external pressure is applied in the desired selective pattern in an amount sufficient that, in combination with the uniform pressure applied by the shrinking film 68, it effects bonding of the film 68 to the inked outer carton surface in a pattern corresponding to that of the applied external pressure. The heat shrinkable films are preferably used only on relatively rigid packages such as those made of glass, metal, thick paperboard or the like so that the shrinking film does not warp or bend the package and thereby possibly inhibit bonding of the film to the inked outer carton surface.

While the principles of the first and second embodiments of the present invention, and to some degree the fifth embodiment, have been expounded in the context of a heat sealable coating, it will be appreciated that the heat-sealable coating merely represents the preferred embodiment of a transparent adhesive layer which would be suitably activated by the application of heat and pressure. Instead of the heat sealable coating described hereinabove, the adhesive layer may be formulated from a "green" or "pressure-sensitive adhesive". Like the heat sealable coating, the pressure sensitive adhesive would be applied in a pattern in the first embodiment and uniformly in the second embodiment but with a selective pattern of heat and pressure securing the film to the ink on the outer package surface in selected differentially adherent patterns. The principles of the present invention may be practiced with other types of adhesive as well, provided they meet the requirements for the adhesive layer——such as transparency in the final state.

The adhesive or heat-sealable coating is preferably applied to the package prior to overwrapping with film, as described in connection with the first, second and fourth embodiments, thereby to minimize any special processing which must be performed by the converter who fills and closes the package and then overwraps it with the transparent film. However, as mentioned earlier in connection with the variations of the first and second embodiments, the adhesive or heat-sealable coating may be applied to the underside of the a pressure-sensitive adhesive rather than a heat sealable coating, application of the pressure sensitive adhesive directly to the transparent film is preferred as otherwise the adhesive coated packages are difficult to transport due to their sticky exterior surface. Similarly, where the transparent film will be processed by the converter in some manner——for example, to add printing thereto——it may be just as convenient for the converter to apply adhesive to the transparent film at the same time as to have the adhesive pre applied to the package.

To summarize, the present invention provides tamper-evident packaging wherein the tampering is evidenced by the appearance of a selected graphic or verbal communication on the outer surface of the container so that even the first-time user of the product will recognize that the product packaging has been tampered with. The notice remains on the carton surface even if new overwrap is applied thereto. Furthermore, the tamper-evident packaging is provided at only a minimal cost over regular packaging.

In contradistinction to tamper-evident packaging systems requiring the use of a uniquely identified, difficult-to-counterfeit overwrap film, the present invention may employ a transparent overwrap film even if that film is totally devoid of visible indicia or is easily counterfeitable, when overwrapping the package. The reason for this is that once the film is removed from the package, it takes with it a selective pattern of ink torn from the package, thereby leaving a selective warning pattern on the package outer surface which would remain visible to a potential consumer even if the package is overwrapped after tampering with another transparent film. Thus the present invention enables cost savings by permitting the use of standard overwrap film rather than overwrap film which has been printed or otherwise uniquely identified. The degree of "transparency" required in the transparent film of the present invention is that level which enables the selected pattern constituting the meaningful message evidencing tampering to be detected through the film by a potential consumer.

Evidence of tampering does not necessarily have a negative implication, but merely means evidence of opening of the package. Such an opening is a warning (i.e., has a negative indication) when the opening is performed by someone other than the purchaser (e.g., when the potential purchaser encounters the message on a presumably unopened product on a store shelf), but has no negative implication when it appears only after the purchaser has himself/herself opened the package (e.g., when viewed on a pantry shelf in the home in a clearly opened condition).

It will be appreciated that a message which can "evidence tampering", as that term is used herein and in the claims, may also——if only by its absence——"evidence non tampering". Thus instead of the message being a warning message indicating that a package has been opened prior to purchase, the message may be a "safe" or "OK to use" message created during opening of the package and thereby indicating that the package was not previously opened, so that the contents thereof are presumably not tampered with. For example, there may be an informative legend on the package over a space which says, > "Before you open this package, the space below should be empty. After you open this package, word SAFE appears in the space before you open the package, or if the word SAFE does not appear in the space after you have opened the package, do not use the package."

The word SAFE would become visible in the designated space as the package was being opened by removal of the transparent overwrap from over the indicated area. Of course, the appropriate legend to be used is a matter of choice. When it is a such message of non-tampering which appears, rather than a message of tampering, it is typically necessary to advise the purchaser by a legend that the message must first appear after he has himself opened the package. Accordingly, a tamper-evident packaging system utilizing such a message of non-tampering typically requires a greater level of communication between the packager and the purchaser than in the instance where the system uses a message of tampering and the mere sight of the message will suffice to warn the potential purchaser. A clear disadvantage of such a system is that a potential purchaser will see a tampered package on a store shelf with the word SAFE on it and proceed to purchase the product despite the legend.

The appearance of the word SAFE or a similar message may be made to appear upon opening of the package according to any of the techniques disclosed herein.

For example, the message (i.e., the word SAFE) and the background of the designated space may be printed in the same color ink, and the ink forming the background of the space may be preferentially secured to the transparent overwrap (relative to the ink forming the message) so that removal of the transparent overwrap removes the background ink to leave the message ink for the first time visible against the now contrasting background formed by the package outer surface in the designated space. Similarly, the message may be formed by the package outer surface but initially overlayed with an ink having the same color as the background ink in the designated space so that in the unopened package the designated space appears to be of uniform color. The ink over the message would be preferentially secured to the transparent overwrap (relative to the background ink) so that removal of the transparent overwrap removes the ink over the message to leave expose the carton outer surface defining the message, which is now for the first time visible against the contrasting background formed by the background ink. Alternatively, the message ink may be of contrasting color to the background ink, but with an overlying ink layer of the same color as the background ink being disposed over the message ink on the unopened package. The overlying ink layer would be preferentially selectively secured to the transparent overwrap (relative to the background ink) so that, upon removal of the transparent overwrap, the overlying ink layer would also be removed to make visible the message ink against the contrasting background ink (that is, to form an at least partially "deinked" outer package surface).

As another example, the legend might say,

"Buy this package only if the word SAFE appears in red in the space below."

The word SAFE would be printed in red in the designated space against a contrasting background, but the red ink forming the word SAFE would be removed with the transparent overwrap when the package was opened, either by a tamperer prior to purchase or by the consumer after purchase. If desired, the red ink forming the word SAFE may actually remain on the package, but the contrasting background of the designated space would be removed with the transparent overwrap to reveal an underlying red background (assuming that is the color of the outer package surface) so that the word SAFE in red would then merge into the background and no longer be visible. Thus, if the package is opened prior to purchase, the potential purchaser would not see the word SAFE in red in the designated space. An obvious disadvantage of this system would be that the purchaser might become disturbed by the disappearance of the word SAFE in red upon his opening of the package at home. Or another member of the purchaser's household may encounter the opened package thereafter and be disturbed by the absence of the word SAFE in red in the designated space.

Referring now in particular to FIGS. 27 and 28, therein illustrated is a tamper-evident system according to the present invention which utilizes a message combining evidence of non-tampering with evidence of tampering and has the distinct advantage of not requiring any legend. As illustrated in FIG. 27, the package 70 contains an ink layer having the visible message "UNOPENED", a message of non tampering. (It will be appreciated that FIG. 27 is similar to FIG. 17 except that the message is different and visible in the unopened package). The message is secured to the transparent film forming end caps 68 in selected differentially adherent patterns so that, as illustrated in FIG. 28, removal of the transparent film 68 from the package also removes the ink of the prefix "UN" of the message while leaving the ink of the body "OPENED" of the message on the outer carton surface as a message of tampering (i.e., opening of the package). The advantage of this system is that no informative legend is required as the potential purchaser in the store would see the message "UNOPENED" and be reassured, and he (or members of his household) would not be discouraged from use of the product at home after it had been opened by the appearance of the factually accurate word "OPENED". Additionally, the "UNOPENED/OPENED" message system has the advantage of not implying that the contents of the package are at any time "SAFE", the term "SAFE" being undesirable as it may have legal implications independent of whether or not any tampering has occurred——for example, depending on whether or not the contents are "SAFE" for people with certain allergies or sensitivities. On the other hand, neutral factual messages such as "UNOPENED" and "OPENED" avoid both the negative and legal implications which might be found from corresponding use of the terms "SAFE" and "UNSAFE", respectively (with the message "SAFE" appearing on the unopened package and being converted to the message "UNSAFE" upon opening of the package).

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the present invention.

We claim:

1. Tamper-evident packaging comprising:

(A) a filled and closed package having an outer surface with ink thereon visible from outside of said closed package; and (B) an end cap of transparent film overwrapping a portion of said closed package less than the entirety thereof, said film being secured to said ink on said outer package surface in selected differentially adherent patterns;

whereby removal of said film from said overwrapped package also removes said ink in one of said selected patterns to reveal a desired pattern of deinked outer package surface and thereby evidence tampering.

2. The package of claim 1 wherein said package defines at least a pair of opposed end panels and a sidewall panel extending between said end panels, and said end cap overwraps at least a portion of one of said end panels and an adjacent portion of said sidewall panel.

3. The packaging of claim 2 wherein said end cap overwraps the entirety of said one end panel, and said adjacent portion of said sidewall panel is contiguous to said one end panel and is less than the entirety of said sidewall panel.

4. The packaging of claim 2 wherein said end cap overwraps the entirety of said one end panel, and said adjacent portion of said sidewall panel is spaced from said one end panel and is less than the entirety of said sidewall panel.

5. The packaging of claim 2 wherein said end cap overwraps the entirety of said one end panel and additionally including another end cap overwrapping the entirety of the other of said end panels and a second adjacent portion of said sidewall panel.

6. The packaging of claim 5 wherein said adjacent and second adjacent portions each comprise less than 50% of the length of said sidewall panel.

7. The packaging of claim 5 wherein there are a spaced pair of said end caps, one for each of said end panels.

8. The packaging of claim 2 wherein said package includes intermediate said end panels a reduced width section, said adjacent portion including said reduced width section, and said film being heat-shrinkable.

9. The packaging of claim 2 wherein said package is an erected box-like carton, said sidewall panel is comprised of a pair of opposed face panels and a pair of opposed side panels, said face panels and side panels extending between said end panels, and said adjacent portion of said sidewall panel is comprised of adjacent portions of at least a pair of opposed panels selected from the group consisting of said opposed face panels and said opposed side panels.

10. The packaging of claim 2 wherein said package is formed substantially of a material other than paper or paperboard and contains as part of said outer package surface and as part of said adjacent portion a label of paper or paperboard having ink thereon visible from outside of said closed package.

11. The packaging of claim 1 wherein said film is printed with indicia visible from outside of said overwrapped package.

12. The packaging of claim 1 wherein said film when overwrapping said package is devoid of visible indicia and when removed from said package contains visible indicia.

13. The packaging of claim 1 wherein said film includes an at least partially transparent coating.

14. The packaging of claim wherein said film is heat-shrinkable.

15. Tamper evident packaging comprising:

(A) an erected, filled, and closed box like carton defining at least a pair of opposed end panels, a pair of opposed face panels, and a pair of opposed side panels, said carton having an outer surface with ink thereon visible from outside of said closed carton; and (B) an end cap of transparent film overwrapping one of said end panels and adjacent portions of at least a pair of opposed panels selected from the group consisting of said opposed face panels and said opposed side panels, said film being secured to said ink on said outer carton surface in selected differentially adherent patterns;

whereby removal of said film from said overwrapped carton also removes said ink in one of said selected patterns to reveal a desired pattern of deinked outer carton surface and thereby evidence tampering.

16. The packaging of claim 15 wherein said end cap overwraps the entirety of said one end panel, and said adjacent portions are contiguous to said one end panel and are less than the entirety of said panels containing said adjacent portions.

17. The packaging of claim 16 additionally including another end cap overwrapping the entirety of the other of said end panels and its adjacent portions.

18. The packaging of claim 16 wherein said adjacent portions comprise less than 50% of the length of said panels containing said adjacent portions.

19. The packaging of claim 15 wherein there are a spaced pair of said end caps, one for each of said end panels.

20. The packaging of claim 15 wherein said end cap overwraps one of said end panels and adjacent portions of said opposed pairs of said face and side panels.

21. The packaging of claim 15 additionally comprising a transparent adhesive coating disposed in said one selected pattern intermediate said ink and said film, said coating being bonded to an underlying portion of said ink and to said film; whereby removal of said film from said overwrapped carton also removes said coating and said underlying portion of said ink in said one selected pattern to reveal an outer carton surface deinked in the form of a meaningful message to evidence tampering.

22. The packaging of claim 16 wherein said coating has been activated by the uniform application of heat and pressure to bond with said film.

23. The packaging of claim 16 wherein said ink is secured to said outer carton surface in a pattern of surface detail by a first bond; said coating is secured to said ink in said one pattern by a second bond; and said film is secured to said coating by a third bond; said second and third bonds being appreciably stronger than said first bond, whereby removal of said film from said overwrapped carton also removes said coating and the portion of said ink underlying said coating to reveal a desired pattern of deinked outer carton surface and thereby evidence tampering.

24. The packaging of claim 15 additionally comprising a transparent adhesive coating uniformly disposed intermediate said ink and said film, said coating uniformly bonding to said ink and having been activated by a selective application of heat and pressure to bond in said one selected pattern with said film; whereby removal of said film from said overwrapped carton also removes said coating in said one selected pattern and an underlying portion of said ink in said one selected pattern to reveal an outer carton surface deinked in the form of a meaningful message to evidence tampering.

25. The packaging of claim 15 wherein said overwrap film is directly and immediately secured to said ink on said outer carton surface in selected differentially adherent patterns as a result of the differential application of heat and pressure to said film.

26. A method of manufacturing tamper evident packaging comprising the steps of:

(A) providing a filled and closed package having an outer surface with ink thereon visible from outside of the closed package; and (B) overwrapping with an end cap of transparent film a portion of the closed package less than the entirety thereof, and securing the film to the ink on the outer package surface in selected differentially adherent patterns;

whereby removal of the film from the overwrapped package also removes the ink in one of the selected patterns to reveal a desired pattern of deinked outer package surface and thereby evidence tampering.

27. The method of claim 26 wherein the package defines at least a pair of opposed end panels and a sidewall panel extending between the end panels, and during overwrapping the end cap overwraps at least a portion of one of the end panels and an adjacent portion of the sidewall panel.

28. The method of claim 27 wherein during overwrapping the end cap overwraps the entirety of the one end panel, and the adjacent portion of the sidewall panel is contiguous to the one end panel and is less than the entirety of the sidewall panel.

29. The method of claim 27 wherein during overwrapping the end cap overwraps the entirety of the one end panel, and the adjacent portion of the sidewall panel is spaced from the one end panel and is less than the entirety of the sidewall panel.

30. The method of claim 27 wherein during overwrapping the end cap overwraps the entirety of the one end panel and another end cap overwraps the entirety of the other of the end panels and a second adjacent portion of the sidewall panel.

31. The method of claim 30 wherein the adjacent and second adjacent portions each comprise less than 50% of the length of the sidewall panel.

32. The method of claim 30 wherein there are a spaced pair of the end caps, one for each of the end panels.

33. The method of claim 27 wherein the package includes intermediate the end panels a reduced width section, the adjacent portion including the reduced width section, and the film being heat-shrinkable.

34. The method of claim 27 wherein the package is an erected box-like carton, the sidewall panel is comprised of a pair of opposed face panels and a pair of opposed side panels, the face panels and side panels extending between the end panels, and the adjacent portion of the sidewall panel is comprised of adjacent portions of at least a pair of opposed panels selected from the group consisting of the opposed face panels and the opposed side panels.

35. The method of claim 27 wherein the package is formed substantially of a material other than paper or paperboard and contains as part of the outer package surface and as part of the adjacent portion a label of paper or paperboard having ink thereon visible from outside of the closed package.

36. The method of claim 26 wherein the film is printed with indicia visible from outside of the overwrapped package.

37. The method of claim 26 wherein the film when overwrapping the package is devoid of visible indicia and when removed from the package contains visible indicia.

38. The method of claim 26 wherein the film includes an at least partially transparent coating.

39. The method of claim 26 wherein the film is heat-shrinkable.

40. A method of manufacturing tamper-evident packaging comprising the steps of:

(A) providing an erected, filled and closed box-like carton defining at least a pair of opposed end panels, a pair of opposed face panels, and a pair of opposed side panels, the carton having an outer surface with ink thereon visible from outside the closed carton; and (B) overwrapping with an end cap of transparent film one of the end panels and adjacent portions of at least a pair of opposed panels selected from the group consisting of the opposed face panels and the opposed side panels, the film being secured to the ink on the outer carton surface in selected differentially adherent patterns;

whereby removal of the film from the overwrapped carton also removes the ink in one of the selected patterns to reveal the desired pattern of deinked outer carton surface to evidence tampering.

41. The method of claim 40 including the step of overwrapping with the end cap the entirety of the one end panel, the adjacent portions being contiguous to the one end panel and being less than the entirety of the panels containing the adjacent portions.

42. The method of claim 41 wherein during overwrapping an end cap is overwrapped about the entirety of each of the end panels and its adjacent portions.

43. The method of claim 41 wherein the overwrapped adjacent portions comprise less than 50% of the length of the panels containing the adjacent portions.

44. The method of claim 40 wherein there are a spaced pair of the end caps, one for each of the end panels.

45. The method of claim 40 wherein during overwrapping the end cap overwraps one of the end panels and adjacent portions of the opposed pairs of the face and side panels.

46. The method of claim 40 wherein prior to step (B) a transparent adhesive coating is disposed in the one selected pattern on the outer carton surface and uniformly bonded to the underlying portion of the ink, and in step (B) the film is secured to the ink by activating the coating by the uniform application of heat and pressure to bond the coating to the film in the one selected pattern; whereby removal of the film from the overwrapped carton also removes the coating and the underlying portion of the ink in the one selected pattern to reveal an outer carton surface deinked in the form of a meaningful message to evidence tampering.

47. The method of claim 40 wherein prior to step (B) a transparent adhesive coating is uniformly disposed on the outer carton surface and uniformly bonded to the underlying ink, and in step (B) the coating is activated by selective application of heat and pressure to bond the coating in the one selected pattern with the film; whereby removal of the film from the overwrapped carton also removes the coating in the one selected pattern and the underlying portion of the ink in the one selected pattern to reveal an outer carton surface deinked in the form of a meaningful message to evidence tampering.

48. The method of claim 40 wherein said ink is secured to the outer carton surface by a first bond, the adhesive coating is secured to the ink by a second bond, and the film is secured to the coating by a third bond, the second and third bonds being stronger than the first bond.

49. The method of claim 40 wherein in step (B) the film is directly and immediately secured to the ink on the outer carton surface in selected differentially adherent patterns as a result of the differential application of heat and pressure to the film.

50. In tamper evident packaging comprising:

(A) an erected, filled and closed package having an outer surface with ink thereon visible from outside of said closed package; and (B) a transparent film overwrapping said closed package and secured to said ink on said outer package surface in selected differentially adherent patterns, whereby removal of said film from said overwrapped package also removes said ink in one of said selected patterns to reveal a desired pattern of deinked outer package surface and thereby evidence tampering;

the improvement comprising a transparent heat-sealable coating disposed intermediate said ink and said film, bonded to said film and activated by heat and pressure to bond with an underlying portion of said ink.

51. The packaging of claim 50 wherein said transparent heat-sealable coating is disposed in said one selected pattern intermediate said ink and said film, said coating being activated by the uniform application of heat and pressure to bond uniformly with said underlying portion of said ink;

whereby removal of said film from said overwrapped package also removes said coating and said underlying portion of said ink in said one selected pattern to reveal an outer package surface deinked in the form of a meaningful message to evidence tampering.

52. The packaging of claim 50 wherein said transparent heat-sealable coating is uniformly disposed intermediate said ink and said film, said coating being activated by the selective application of heat and pressure to bond in said one selected pattern with said ink;

whereby removal of said film from said overwrapped package also removes said coating in said one selected pattern and an underlying portion of said ink in said one selected pattern to reveal an outer package surface deinked in the form of a meaningful message to evidence tampering.

53. In a method of manufacturing tamper-evident packaging comprising the steps of:

(A) providing an erected, filled and closed package having an outer surface with ink thereon visible from outside the closed package; and (B) overwrapping the closed package with a transparent film and securing the film to the ink on the outer package surface in selected differentially adherent patterns, whereby removal of the film from the overwrapped package also removes the ink in one of the selected patterns to reveal the desired pattern of deinked outer package surface t evidence tampering;

the improvement comprising prior to step (B) providing a transparent heat sealable coating disposed on the surface of the transparent film to be adjacent the outer package surface, and in step (B) activating the coating by the application of heat and pressure to bond the coating to the ink.

54. The method of claim 53 wherein prior to step (B) the transparent heat-sealable coating is disposed in the one selected pattern on the surface of the transparent film to be adjacent the outer package surface, and in step (B) the coating is activated by the uniform application of heat and pressure to bond the coating to the ink in the one selected pattern;

whereby removal of the film from the overwrapped package also removes the coating and the underlying portion of the ink in the one selected pattern to reveal an outer package surface deinked in the form of a meaningful message to evidence tampering.

55. The method of claim 53 wherein prior to step (B) the transparent heat-sealable coating is uniformly disposed on the surface of the transparent film to be adjacent the outer package surface and uniformly bonded to that film surface, and in step (B) the coating is activated by the selective application of heat and pressure to bond the coating in the one selected pattern with the ink;

whereby removal of the film from the overwrapped package also removes the coating in the one selected pattern and the underlying portion of the ink in the one selected pattern to reveal an outer package surface deinked in the form of a meaningful message to evidence tampering.

56. Tamper-evident packaging comprising (A) an erected, filled and closed package having an outer surface layer;

(B) an ink layer overlying at least a portion of said package outer surface layer, visible from outside said closed package, and bonded to an underlying layer other than a release coating;

(C) a transparent film layer overwrapping at least a portion of said closed package, disposed about said ink layer, and bonded to an underlying layer other than a release coating;

said ink layer being bonded to one of said transparent film and outer package surface layers uniformly and to the other of said layers in selected differentially adherent patterns, whereby removal of said film from said overwrapped package also removes said ink in one of said selected patterns to reveal a desired pattern of deinked outer package surface and thereby evidence tampering; and (D) a release coating layer defining a pattern of release coating, disposed intermediate a pair of said layers (A), (B) and (C), and causing the differential adhesion of said selected differentially adherent patterns.

57. The packaging of claim 56 wherein said release coating layer either precludes removal of a selected pattern of the underlying one of said pair of layers with the removal of the overlying one of said pair of layers to reveal a desired pattern evidencing tampering or enables removal of a selected pattern of the overlying one of said pair of layers from the underlying one of said pair of layers to reveal a desired patter evidencing tampering.

58. The packaging of claim 56 wherein said release coating layer is disposed intermediate said package outer surface layer and said ink layer and enables removal of said one selected pattern of said ink layer with said transparent film layer to reveal a desired pattern of deinking.

59. The packaging of claim 58 wherein said pattern of release coating is a positive image of the desired pattern of deinking.

60. The packaging of claim 58 wherein said release coating layer is transparent.

61. The packaging of claim 58 wherein said release coating layer is opaque.

62. The packaging of claim 58 additionally comprising a transparent heat-sealable layer overlying at least a portion of said closed package, disposed intermediate said ink and transparent film layers, and bonded to underlying and overlying layers other than said release coating layer, said release coating layer enabling removal of said one selected pattern of said ink layer with said transparent film and heat-sealable layers to reveal the desired pattern of deinking.

63. The packaging of claim 62 wherein said pattern of release coating is a positive image of the desired pattern of deinking.

64. The packaging of claim 56 wherein said ink layer is uniformly bonded to said package outer surface layer, and said release coating layer is disposed intermediate said ink layer and said transparent film layer and precludes removal of a pattern of said ink layer with said transparent film layer to reveal a desired pattern of deinking.

65. The packaging of claim 64 wherein said pattern of release coating is a negative image of the desired pattern of deinking.

66. The packaging of claim 64 wherein said release coating layer is transparent.

67. The packaging of claim 64 additionally comprising a transparent heat-sealable layer overlying at least a portion of said closed package, disposed intermediate said ink and transparent film layers, and bonded to underlying and overlying layers other than said release coating layer.

68. The packaging of claim 67 wherein said release coating layer is disposed intermediate said ink layer and said heat-sealable layer and precludes removal of a pattern of said ink layer with said transparent film and heat-sealable layers to reveal the desired pattern of deinking.

69. The packaging of claim 68 wherein said pattern of release coating is a negative image of the desired pattern of deinking.

70. The packaging of claim 68 wherein said release coating layer is transparent.

71. The packaging of claim 68 wherein all of said heat-sealable layer is directly bonded to said transparent film layer, whereby removal of a portion of said transparent film layer also removes the underlying portion of said heat-sealable layer.

72. The packaging of claim 67 wherein said release coating layer is disposed intermediate said heat-sealable layer and said transparent film layer and precludes removal of a pattern of said ink layer with said transparent film layers to reveal a desired pattern of deinking.

73. The packaging of claim 72 wherein said pattern of release coating is a negative image of the desired pattern of deinking.

74. The packaging of claim 72 wherein said release coating layer is transparent.

75. The packaging of claim 72 wherein only a part of said heat-sealable layer is directly bonded to said transparent film layer, whereby removal of a portion of said transparent film layer also removes only a part of the underlying portion of said heat-sealable layer.

76. In a method of manufacturing tamper-evident packaging comprising the steps of:

(A) providing an erected, filled and closed package having an outer surface layer;

(B) forming an ink layer overlying at least a portion of the package outer surface layer, visible from outside the closed package, and bonded to an underlying layer other than a release coating; and (C) overwrapping at least a portion of the closed package with a transparent film layer disposed about the ink layer and bonded to an underlying layer other than a release coating;

the ink layer being bonded to one of the transparent film and outer package surface layers uniformly and to the other of the layers in selected differentially adherent patterns, whereby removal of the film from the overwrapped package also removes the ink in one of the selected patterns to reveal a desired pattern of deinked outer package surface and thereby evidence tampering;

the improvement comprising the step of providing a release coating layer defining a pattern of release coating, disposed intermediate a pair of the aforesaid layers, and causing the differential adhesion of the selected differentially adherent patterns.

77. The method of claim 76 wherein the release coating layer is disposed so as either to preclude removal of a selected pattern of the underlying one of the pair of layers with the removal of the overlying one of the pair of layers to reveal a desired pattern evidencing tampering or to enable removal of a selected pattern of the overlying one of the pair of layers from the underlying one of the pair of layers to reveal a desired pattern evidencing tampering.

78. The method of claim 76 wherein the release coating layer is provided intermediate the carton outer surface layer and the ink layer and enables removal of the one selected pattern of the ink layer with the transparent film layer to reveal a desired pattern of deinking.

79. The method of claim 78 wherein the pattern of release coating is provided as a positive image of the desired pattern of deinking.

80. The method of claim 78 wherein the release coating layer is transparent.

81. The method of claim 78 wherein the release coating layer is opaque.

82. The method of claim 78 additionally comprising the step of providing a transparent heat sealable layer overlying at least a portion of the closed package, disposed intermediate the ink and transparent film layers, and bonded to underlying and overlying layers other than the release coating layer, the release coating layer enabling removal of the one selected pattern of the ink layer with the transparent film and heat-sealable layers to reveal the desired pattern of deinking.

83. The method of claim 82 wherein the pattern of release coating is a positive image of the desired pattern of deinking.

84. The method of claim 76 wherein the ink layer is uniformly bonded to the package outer surface layer and the release coating layer is disposed intermediate the ink layer and the transparent film layer and precludes removal of a pattern of the ink layer with the transparent film layer to reveal a desired pattern of deinking.

85. The method of claim 84 wherein the pattern of release coating is provided as a negative image of the desired pattern of deinking.

86. The method of claim 84 wherein the release coating layer is transparent.

87. The method of claim 84 additionally comprising the step of providing a transparent heat-sealable layer overlying at least a portion of the closed package, disposed intermediate the ink and transparent film layers, and bonded to underlying and overlying layers other than the release coating layer.

88. The method of claim 87 wherein the release coating layer is disposed intermediate the ink layer and the heat-sealable layer and precludes removal of a pattern of the ink layer with the transparent film and heat sealable layers to reveal the desired pattern of deinking.

89. The method of claim 87 wherein the pattern of release coating is provided as a negative image of the desired pattern of deinking.

90. The method of claim 88 wherein the release coating layer is transparent.

91. The method of claim 88 wherein all of the heat-sealable layer is directly bonded to the transparent film layer, whereby removal of a portion of the transparent film layer also removes the underlying portion of the heat sealable layer.

92. The method of claim 87 wherein the release coating layer is disposed intermediate the heat-sealable layer and the transparent film layer and precludes removal of a pattern of the ink layer with the transparent film layers to reveal a desired pattern of deinking.

93. The method of claim 92 wherein the pattern of release coating is provided as a negative image of the desired pattern of deinking.

94. The method of claim 92 wherein the release coating layer is transparent.

95. The method of claim 92 wherein only a part of the heat-sealable layer is directly bonded to the transparent film layer, whereby removal of a portion of the transparent film layer also removes only a part of the underlying portion of the heat-sealable layer.

96. Tamper-evident packaging comprising:

(A) a filled and closed package having an outer surface with ink thereon visible from outside of said closed package; and (B) transparent film overwrapping at least a portion of said closed package, said film being secured to said ink on said outer package in selected differentially adherent patterns;

whereby removal of said film from said overwrapped package also removes said ink in one of said selected patterns to reveal a desired pattern of deinked outer package surface and thereby evidence tampering;

said ink being in the form of the word "UN-OPENED" and the "UN" and the "OPENED" of said ink being secured to said film in selected differentially adherent patterns with the "UN" being more adherent to said film than said "OPENED", whereby removal of said film from said overwrap package also removes said "UN" to reveal the deinked outer package surface therebelow to evidence opening of the package.

97. The tamper-evident packaging of claim 1 wherein said ink is in the form of a self-explanatory evidencing non-tampering and is secured to said film in selective differentially adherent patterns such that removal of said film from said overwrap package converts said message of non-tampering to a self-explanatory message of tampering.

98. Tamper-evident packaging comprising (A) an erected, filled and closed package having an outer surface layer;

(B) an ink layer overlying at least a portion of said package outer surface layer, visible from outside said closed package, and bonded to an underlying layer other than a release coating;

(C) a transparent film layer overwrapping at least a portion of said closed package, disposed about said ink layer, and bonded to an underlying layer other than a release coating;

said ink layer forming the message "UN-OPENED" and being bonded to one of said transparent film and said outer package surface layers uniformly and to the other of said layers in selected differentially adherent patterns, whereby removal of said transparent film from said overwrapped package also removes the portion of said ink layer forming "UN" to reveal the deinked outer package surface and leave the portion of said ink layer forming "OPENED" to evidence opening of the package; and (D) a release coating layer defining a pattern of release coating, disposed intermediate a pair of said layers (A), (B) and (C), and causing the differential adhesion of said selected differentially adherent patterns.

99. The tamper-evident packaging of claim 56 wherein said ink layer forms a self-explanatory message evidencing a non-tampered package and is bonded to one of said transparent film and said outer carton surface layers uniformly and to the other of said layers in selected differentially adherent patterns such that removal of said transparent film from said overwrapped carton also converts said message into a self-explanatory message evidencing opening of the package.

100. The packaging of claim 1 wherein said film is gas-permeable.

101. The packaging of claim 1 wherein said ink on said outer surface is not removable therefrom without visible tearing of said outer surface.

102. The packaging of claim 1 wherein said desired pattern of deinked outer package surface evidences tampering by means of a self-explanatory message.

* * * * *